United States Patent [19]

Mihara et al.

[11] Patent Number: 4,801,525

[45] Date of Patent: Jan. 31, 1989

[54] INFRARED SENSITIZED SILVER HALIDE LIGHT-SENSITIVE ELEMENT WITH MORDANT DYE OVER LAYER

[75] Inventors: Yuji Mihara; Kunio Ishigaki, both of Kanagawa, Japan

[73] Assignee: Fuji Photo Film Co., Ltd., Kanagawa, Japan

[21] Appl. No.: 80,189

[22] Filed: Jul. 31, 1987

Related U.S. Application Data

[63] Continuation of Ser. No. 823,844, Jan. 29, 1986, abandoned.

[30] Foreign Application Priority Data

Jan. 29, 1985 [JP] Japan ..... 60-14961

[51] Int. Cl.[4] ..... G03C 1/84

[52] U.S. Cl. ..... 430/518; 430/507; 430/511; 430/517; 430/944; 430/961

[58] Field of Search ..... 430/517, 944, 961, 507, 430/511, 518

[56] References Cited

U.S. PATENT DOCUMENTS

| | | | |
|---|---|---|---|
| 4,420,555 | 12/1985 | Kruegar et al. | 430/517 |
| 4,536,473 | 8/1985 | Mihara et al. | 430/944 |
| 4,574,115 | 3/1986 | Adachi et al. | 430/961 |
| 4,581,325 | 4/1986 | Kitchin et al. | 430/961 |

*Primary Examiner*—Jack P. Brammer

*Attorney, Agent, or Firm*—Sughrue, Mion, Zinn, Macpeak & Seas

[57] ABSTRACT

A silver halide light-sensitive material is disclosed, comprising a support having provided thereon a silver halide emulsion layer that has been infrared-sensitized so as to have a sensitivity maximum at a wavelength longer than 750 nm and at least one light-insensitive hydrophilic colloidal layer on said silver halide emulsion layer, wherein said light-insensitive hydrophilic colloidal layer contains at least one dye having an absorption maximum at a wavelength shorter than 750 nm. The material has high sensitivity to infrared light, but can be handled under bright safelight.

9 Claims, No Drawings

INFRARED SENSITIZED SILVER HALIDE LIGHT-SENSITIVE ELEMENT WITH MORDANT DYE OVER LAYER

This is a continuation, of application Ser. No. 823,844, filed Jan. 29, 1986, now abandoned.

FIELD OF THE INVENTION

This invention relates to a silver halide light-sensitive material. More particularly, it relates to a silver halide light-sensitive material which can be handled under bright safelight and has high sensitivity.

BACKGROUND OF THE INVENTION

Silver halide light-sensitive materials should be handled in full darkness or under safelight having a wavelength region to which the light-sensitive materials are substantially insensitive. As sensitivity of light-sensitive materials becomes higher, the safelight should have so much reduced quantity of light, which naturally interferes with the ability to easily handle the light-sensitive materials. Therefore, it has been strongly desired to develop a photographic light-sensitive material that can be handled under bright safelight conditions. However, such a light-sensitive material that has high sensitivity but can also be handled under bright safelight has not yet been obtained. In particular, there has been a demand in the field of printing plates that contact exposure using a relatively low sensitive light-sensitive material could be carried out in a bright room. In compliance with this demand, photographic light-sensitive materials which can be handled in an atmosphere that may be called a substantially bright room while using a silver halide as a light-sensitive element have recently been proposed. This proposal can be embodied by a combination of a light-sensitive material having an extremely reduced sensitivity to visible light, i.e., about $1/10^4$ to $1/10^5$ the sensitivity of conventional photographic light-sensitive materials, and a printor having a powerful light source containing a large quantity of ultraviolet rays. With reference to such a silver halide light-sensitive material that can be handled in a bright room, Japanese Patent Application (OPI) Nos. 125734/81, 149030/81 and 149031/81, etc. (the term "OPI" as used herein refers to a "published unexamined Japanese patent application") disclose silver halide emulsions which are prepared in the presence of a large amount of a rhodium salt. However, these known emulsions exhibit such low sensitivities that they require a long time for exposure even with a powerful light source. Therefore, light-sensitive materials which not only have sufficiently high sensitivities, i.e., can be exposed in a short time, but also can be handled under safelight that may be referred to as bright room conditions has not yet been developed.

On the other hand, it is well known that a light-sensitive wavelength region of a silver halide light-sensitive emulsion can be broadened to a longer side by adding a certain kind of cyanine dyes to the emulsion (spectral sensitization). It is also known that this spectral sensitization can be applied not only to a visible wavelength region but also to an infrared wavelength region. Spectral sensitization can be carried out by using sensitizing dyes showing absorption in a visible or infrared region. Examples of these sensitizing dyes are described, e.g., in Mees and James, *The Theory of the Photographic Process*, 3rd Ed., 198–201, Macmillan (1966).

When these known sensitizing dyes are used for spectral sensitization in a visible region, the wavelength region of applicable safelight is naturally limited to a narrow range. If in using for spectral sensitization in an infrared region, the resulting light-sensitive material thus sensitized to an infrared region exhibits not only sensitivity to an infrared region but also sufficient sensitivity to a visible region. As a result, the infrared-sensitized light-sensitive material cannot be handled except under safelight conditions of very low lightness or in total darkness. For example, a commercially available infrared sensitive light-sensitive material, Sakura Sekigai 750 (produced by Konishiroku Photo Industry Co., Ltd.) is specified to be handled in total darkness. It is also specified that use of safelight should be limited to lighting for several seconds at the end of development. Similarly, Kodak HIE 135-20, trademark for an infrared sensitive light-sensitive material produced by Eastman Kodak Co., is specified to be handled in total darkness.

In the use of the infrared light-sensitive materials, it has been strongly desired that they can be handled under bright safelight unlike the above-described conventional infrared light-sensitive materials, thus greatly improving workability.

However, as described above, it has so far been impossible to handle light-sensitive materials having increased sensitivity by spectral sensitization under safelight that may be referred to as bright light. Accordingly, light-sensitive materials presently must be selected from the alternatives of those which can be handled under bright safelight but require long exposure due to low sensitivity or those which should be handled under dark safelight but require short exposure due to high sensitivity.

SUMMARY OF THE INVENTION

An object of this invention is to provide a silver halide light-sensitive material having sufficiently low sensitivity to visible light and high sensitivity to infrared light.

Another object of this invention is to provide a silver halide light-sensitive materail having high sensitivity to infrared light which is free from color remaining after development processing.

The above objects can be accomplished by a silver halide light-sensitive material which comprises a support having provided thereon a silver halide light-sensitive emulsion layer that has been infrared-sensitized so as to have a sensitivity maximum at a wavelength longer than 750 nm (hereinafter referred to as "infrared sensitive silver halide emulsion layer") and at least one light-insensitive hydrophilic colloidal layer on said silver halide light-sensitive emulsion layer (i.e., on the opposite surface side of the emulsion layer to the support), wherein said light-insensitive hydrophilic colloidal layer contains at least one water-soluble dye having an absorption maximum at a wavelength shorter than 750 nm.

DETAILED DESCRIPTION OF THE INVENTION

The infrared sensitive silver halide emulsion layer in accordance with the present invention may be provided in a plurality of layers but, usually, sufficiently be provided in a single layer. The silver coverage of the infrared sensitive silver halide emulsion layer preferably ranges from 1 to 8 $g/m^2$.

The light-insensitive hydrophilic colloidal layer according to the present invention should be provided in the upper portion of the infrared sensitive silver halide emulsion layer, i.e., farther side from the support of the infrared sensitive silver halide emulsion layer, and a dye is incorporated in this light-insensitive layer in such an amount sufficient for the above-described infrared sensitive layer halide emulsion layer to lose its sensitivity to visible light. The light-insensitive hydrophilic colloidal layer containing the dye may be provided on the infrared sensitive silver halide emulsion layer either in direct contact therewith or via an intermediate layer. The dye-containing light-insensitive hydrophilic colloidal layer may have further provided thereon another light-insensitive hydrophilic colloidal layer.

The water-soluble dye having an absorption maximum at a wavelength shorter than 750 nm may also be added to a silver halide light-sensitive emulsion layer as well as to the light-insensitive hydrophilic colloidal layer.

The water-soluble dyes having an absorption maximum at a wavelength shorter than 750 nm which can be used in the present invention include oxonol dyes, hemioxonol dyes, merocyanine dyes, cyanine dyes, azo dyes, and the like. The fact that these dyes are water-soluble contributes to prevent color remaining after processing.

Examples of dyes which can be used in the present invention are pyrazolone oxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284 and 3,718,472, enaminohemioxonol dyes described in U.S. Pat. No. 3,976,661, and dyes described in British Pat. Nos. 584,609 and 1,177,429, Japanese Patent Application (OPI) Nos. 85130/73, 99620/74 and 114420/74, U.S. Pat. Nos. 2,533,472, 3,148,187, 3,177,078, 3,247,127, 3,540,887, 3,575,704 and 3,653,905.

In the present invention water-soluble dyes having an absorption maximum in wavelengths between 350 nm and 750 nm, particularly between 600 nm and 750 nm, are preferred. Among them, dyes having a ratio of a density at 780 nm to a density at absorption maximum ($D_{780}/D_{max}$) of 0.6 or less are more preferred. Such preferred dyes having an absorption maximum in wavelengths between 600 nm and 750 nm include those represented by the following formulae (Ia) to (Id)

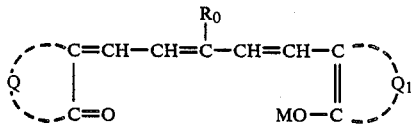

(Ia)

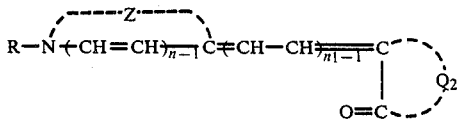

(Ib)

-continued

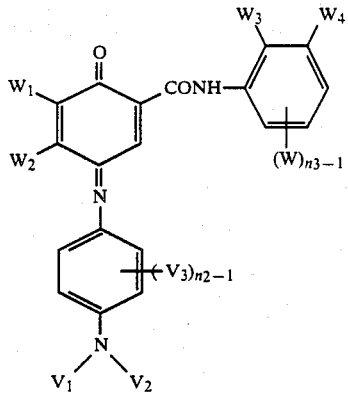

(Ic)

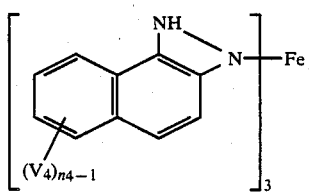

(Id)

wherein Q and $Q_1$ (which may be the same or different) each represents an atomic group necessary to form a pyrazolone, barbituric acid, thiobarbituric acid, isooxazolone, 3-oxythionaphthene or 1,3-indanedione group; $Q_2$ represents an atomic group necessary to form a pyrazolone, barbituric acid, thiobarbituric acid, isooxazolone, 3-oxynaphthene, 1,3-indanedione, 2-thiooxazolidinedione, rhodanine or thiohydantoin group; Z represent a non-metallic atomic group necessary to form a benzothiazole, naphthothiazole, benzoxazole or naphthoxazole group; $R_0$ represents a hydrogen atom, a halogen atom or a lower alkyl group (preferably having 1 to 4 carbon atoms); R represents a substituted or unsubstituted alkyl group (preferably having 1 to 10 carbon atoms); W, $W_1$, $W_2$, $W_3$ and $W_4$ each represents a hydrogen atom, an alkyl group (preferably having 1 to 8 carbon atoms), a substituted alkyl group (preferably having 1 to 8 carbon atoms), a nitro group, a cyano group, a halogen atom, an alkoxy group (preferably having 1 to 8 carbon atoms), a sulfo group, or a carboxyl group; $W_1$ and $W_2$ or $W_3$ and $W_4$ may be taken together to form a benzene ring, respectively; $V_4$ represents a sulfo group or a carboxyl group; $V_1$, $V_2$ and $V_3$ (which may be the same or different) each represents an alkyl group (preferably having 1 to 8 carbon atoms) or a substituted alkyl group (preferably having 1 to 8 carbon atoms); M represents a hydrogen atom, a sodium atom, or a potassium atom; n represents 1 or 2; $n_1$ represents 2 or 3; $n_2$ and $n_3$ each represents 1, 2, or 3; and $n_4$ represents 2, 3 or 4.

Specific examples of the dyes which can be used in the present invention are set forth below:

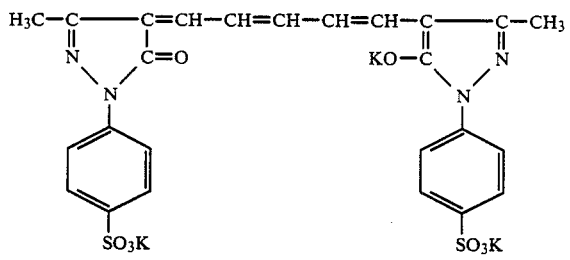
I-1
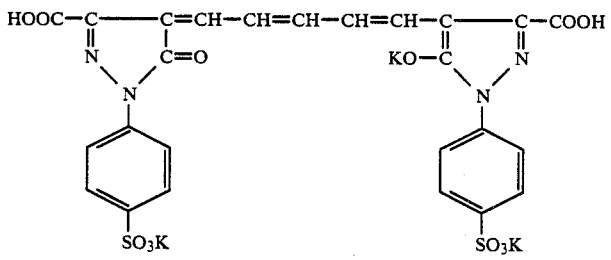
I-2
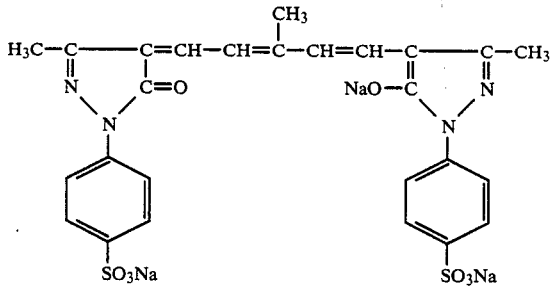
I-3
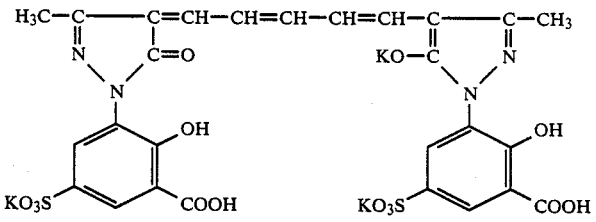
I-4
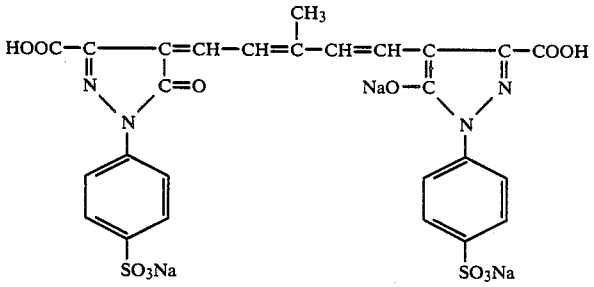
I-5
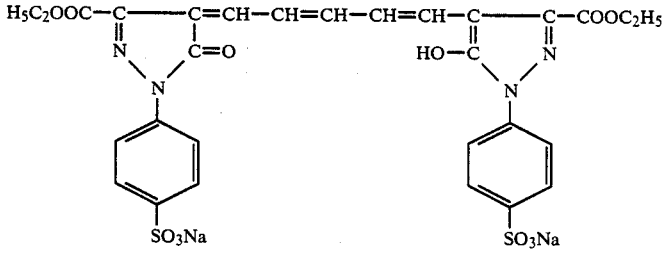
I-6

-continued

I-7

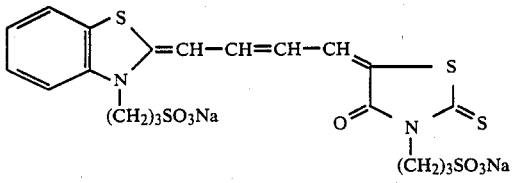

I-8

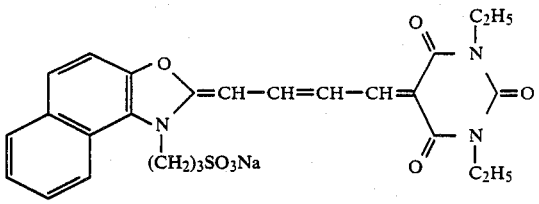

I-9

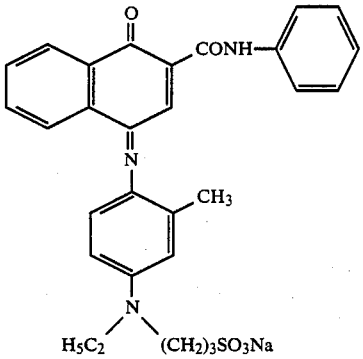

I-10

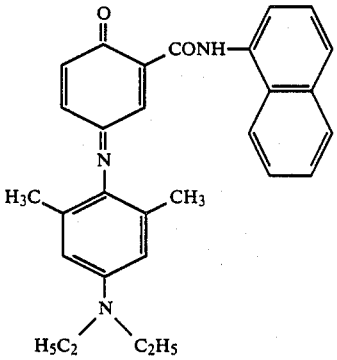

I-11

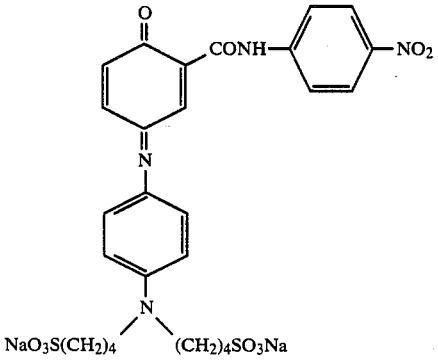

I-12

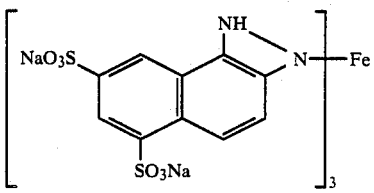

I-13

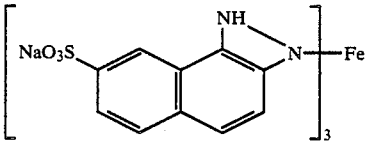

In addition to the above-described dyes having absorption maxima in a red light region, dyes having absorption maxima in further shorter wavelengths can also be employed. Such dyes having absorption maxima in further shorter wavelengths include those represented by the following formulae (IIa) to (IIf)

(IIa)

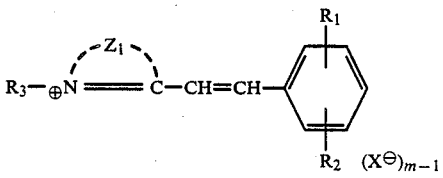

(IIb)

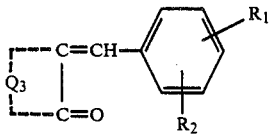

-continued (IIc)

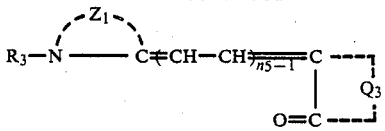

(IId)

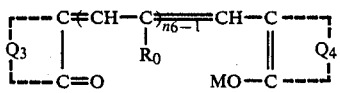

wherein $Z_1$ represents a non-metallic atomic group necessary to form a benzothiazole, naphthothiazole or benzoxazole group; $Q_3$ and $Q_4$ each represents an atomic group necessary to form a pyrazolone, barbituric acid, thiobarbituric acid, isooxazolone, 3-oxythionaphthene or 1,3-indanedione group; $R_0$ represents a substituted or unsubstituted alkyl group (preferably having 1 to 4 carbon atoms); $R_1$ and $R_2$ each represents a hydrogen atom, an alkoxy group (preferably having 1 to 8 carbon atoms), a dialkylamino group, a sulfo group or a halogen atom; $R_3$ represents a substituted or unsubstituted alkyl group (preferably having 1 to 10 carbon atoms): M represents a hydrogen atom, a soium atom or a potassium atom; $X^{\ominus}$ represents an anion; and m, $n_5$ and $n_6$ each represents 1 or 2; with the proviso that when m is 1 in the formula (IIa), $X^{\ominus}$ forms an inner salt.

(IIe)

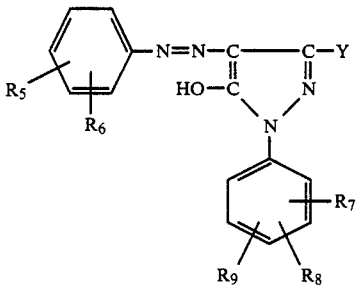

(IIf)

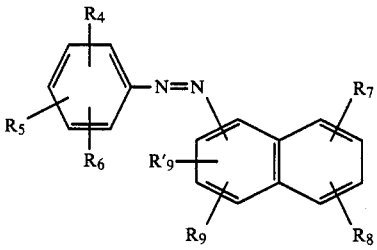

wherein Y represents an alkyl group (preferably having 1 to 8 carbon atoms) or a carboxyl group; and $R_4$, $R_5$, $R_6$, $R_7$, $R_8$, $R_9$ and $R'_9$ each represents a hydrogen atom, an alkyl group (preferably having 1 to 8 carbon atoms), a hydroxyl group, an amino group, an acylamino group, a carboxyl group or a sulfo group; and $R_5$ and $R_6$ may be taken together to form a benzene ring.

Among the dyes repre;sented by the above-described formulae (IIa) to (IIf), those containing an acid group, e.g., a sulfo group, a carboxyl group, etc., are preferred.

Specific preferred examples of the dyes represented by formulae (IIa) to (IIf) are shown below:

II-1

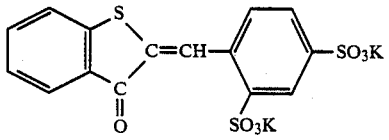

II-2

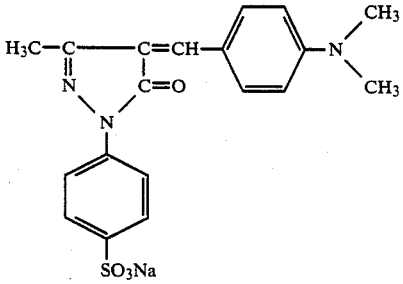

-continued

II-3

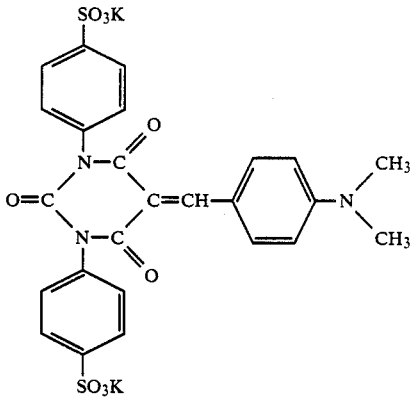

II-4

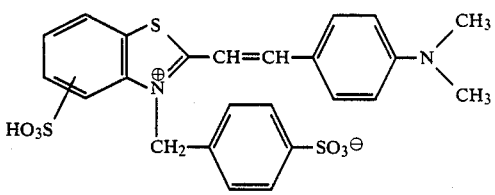

II-5

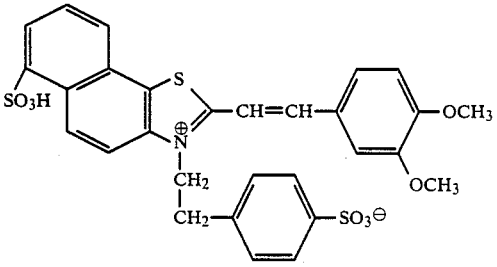

II-6

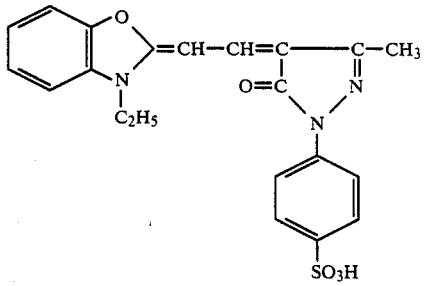

II-7

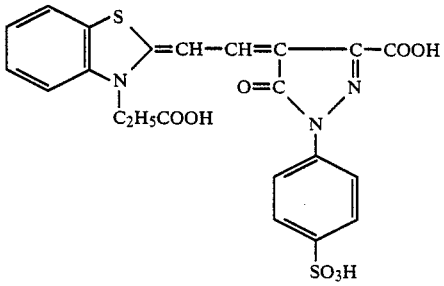

-continued
II-8
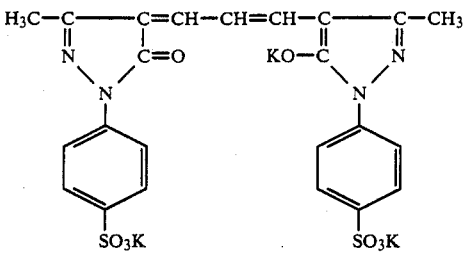
II-9
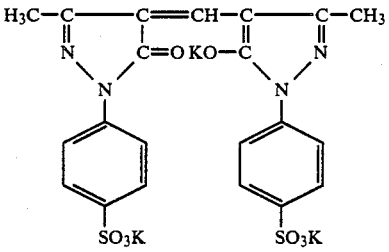
II-10
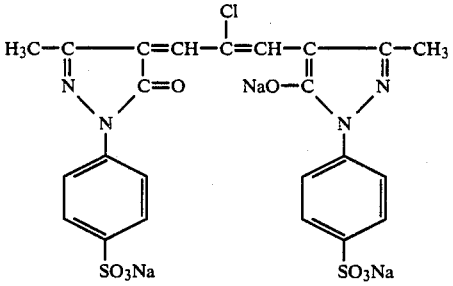
II-11
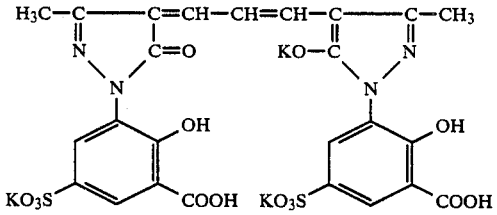
II-12
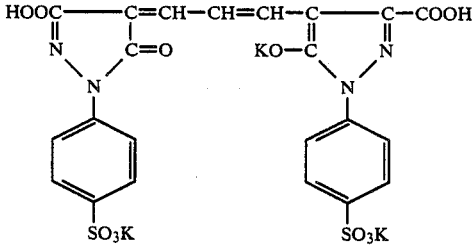
II-13
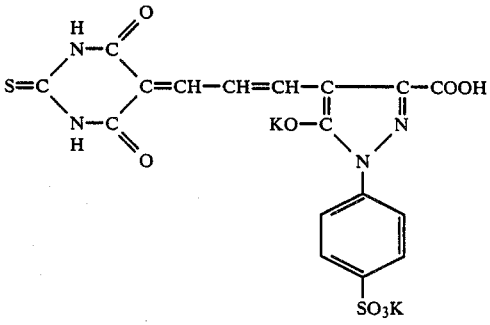
-continued
II-14
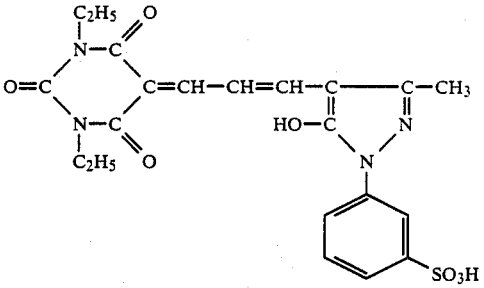
II-15
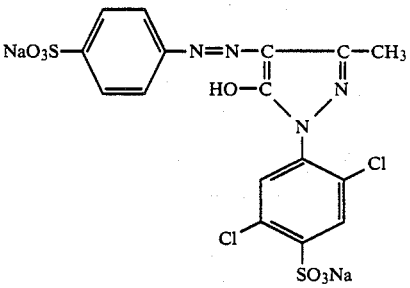
II-16
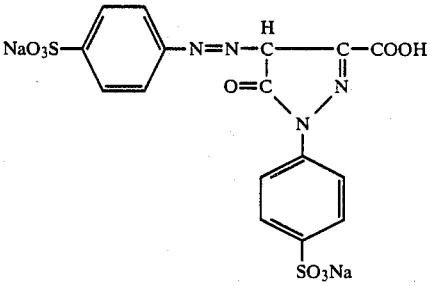
II-17
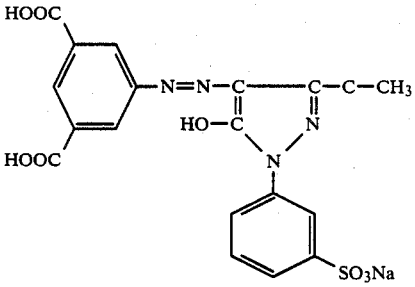
II-18
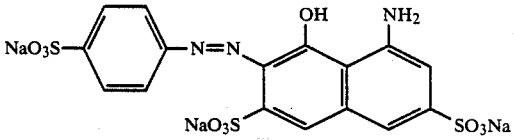
II-19
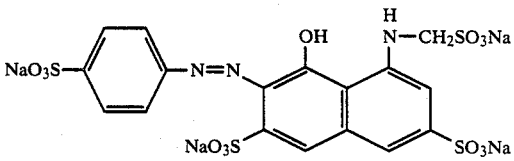

-continued

II-20

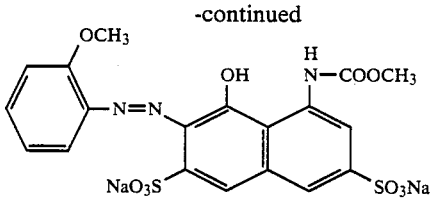

II-21

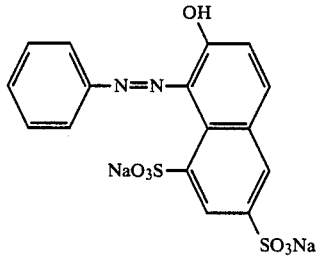

II-22

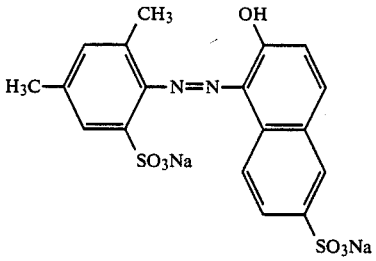

II-23

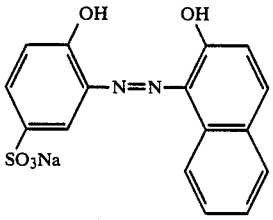

II-24

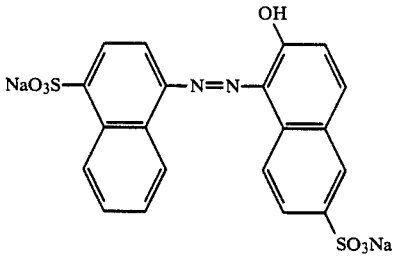

Incorporation of these dyes in the light-insensitive hydrophilic colloidal layer can be carried out by dissolving them in an appropriate solvent, such as water, alcohols (e.g., methanol, ethanol, propanol, etc.), acetone, methyl cellosolve, etc., and mixtures thereof, and adding the solution to a coating composition for the light-insensitive hydrophilic colloidal layer.

These dyes may be used individually or in combinations of two or more thereof. The amount of the dye to be added cannot be definitely specified, but usually falls within a range of from $10^{-3}$ to 1 g/m$^2$, and preferably from $10^{-3}$ to 0.5 g/m$^2$.

The dye may be present also in the silver halide emulsion layer, but it is preferably present only in the light-insensitive hydrophilic colloidal layer. The dye can be prevented from diffusing from the light-insensitive hydrophilic colloidal layer to the emulsion layer by, for example, coating a light-insensitive hydrophilic colloidal layer containing a nondiffusible dye having an absorption maximum at a wavelength shorter than 750 nm onto a completely set silver halide emulsion layer. In the case where an emulsion layer and a light-insensitive hydrophilic colloidal layer are simultaneously coated by two-coat simultaneous coating, it is most preferred to add the nondiffusible dye or a dye having an absorption maximum at a wavelength shorter than 750 nm together with a polymer mordant to the light-insensitive hydrophilic colloidal layer.

The polymer mordants which can be used in the present invention include polymers containing secondary and tertiary amino groups, polymers having a nitrogen-containing heterocyclic moiety, polymers containing a quaternary cation group of the above groups or moiety and has a molecular weight of from about 5,000 to about 200,000, and preferably from about 10,000 to about 50,000.

Examples of such polymer mordants are vinylpyridine polymers and vinylpyridinium cation polymers as disclosed in U.S. Pat. Nos. 2,548,564, 2,484,430, 3,148,061 and 3,756,814, etc.; polymer mordants that are cross-linkable with gelatin as disclosed in U.S. Pat. Nos. 3,625,694, 3,859,096 and 4,128,538 and British Pat. No. 1,277,453; aqueous sol type mordants as disclosed in U.S. Pat. Nos. 3,958,995; 2,721,852 and 2,798,063, and Japanese Patent Application (OPI) Nos. 115228/79, 145529/79 and 126927/79, etc.; water-insoluble mordants as disclosed in U.S. Pat. No. 3,898,088; reactive mordants capable of covalent-bonding with dyes as disclosed in U.S. Pat. No. 4,168,976 (corresponding to Japanese Patent Application (OPI) No. 137333/79); the mordants described in U.S. Pat. Nos. 3,709,690, 3,788,855, 3,642,482, 3,488,706, 3,557,066, 3,271,147 and 3,271,148 and Japanese Patent Application (OPI) Nos. 71332/75, 30328/78, 155528/77, 125/78 and 1024/78; and the mordants described in U.S. Pat. Nos. 2,675,316 and 2,882,156.

Of these mordants, those which hardly move from the light-insensitive hydrophilic colloidal layer to other layers are preferred. For example, mordants which are cross-linkable with hydrophilic colloids, e.g., gelatin; water-insoluble mordants; and aqueous sol (or latex dispersion) type mordants are preferably used.

Examples of particularly preferred polymer mordants are listed below.

(1) Polymers having a quaternary ammonium group and a group capable of covalent-bonding with gelatin, e.g., an aldehyde group, a chloroalkanoyl group, a chloroalkyl group, a vinylsulfonyl group, a pyridiniumpropionyl group, a vinylcarbonyl group, an alkylsulfonoxy group, etc., with specific examples thereof being represented by the formula:

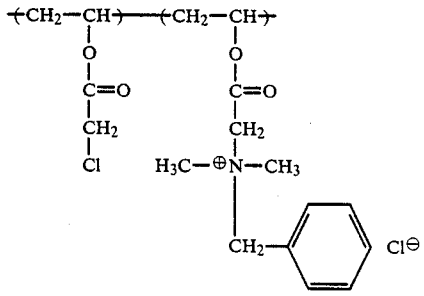

(2) Reaction products between (a) a copolymer comprising a monomer unit represented by the formula (Ma):

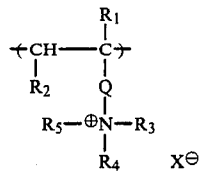

(Ma)

wherein $R_1$ represents a hydrogen atom or a substituted or unsubstituted alkyl group; $R_2$ represents a hydrogen atom, a substituted or unsubstituted alkyl group or a substituted or unsubstituted aryl group; Q represents a divalent group; $R_3$, $R_4$ and $R_5$ each represents a hydrogen atom, a substituted or unsubstituted alkyl group or a substituted or unsubstituted aryl group, or at least two of $R_3$, $R_4$ and $R_5$ may be taken together to form a heterocyclic ring; and $X^{\ominus}$ represents an anion; and another ethylenically unsaturated monomer unit and (b) a cross-linking agent, e.g., a bisalkane sulfonate, a bisarylene sulfonate, etc.

(3) Polymers represented by the formula (Mb):

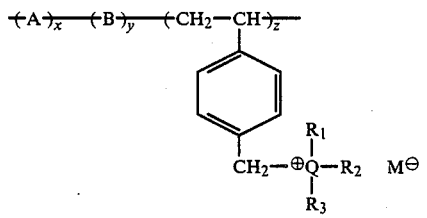

(Mb)

wherein x is from about 0.25 to about 5 mol%; y is from about 0 to about 90 mol%; z is from about 10 to about 99 mol%; A represents a monomer unit having at least two ethylenically unsaturated bonds; B represents a copolymerizable ethylenically unsaturated monomer unit; Q represents a nitrogen atom or a phosphorus atom; and $R_1$, $R_2$ and $R_3$ each represents a substituted or unsubstituted alkyl group or a substituted or unsubstituted cyclic hydrocarbon group; or at least two of $R_1$, $R_2$ and $R_3$ may be taken together to form a ring.

(4) Copolymers comprising (a) a monomer unit represented by the formula (Mc):

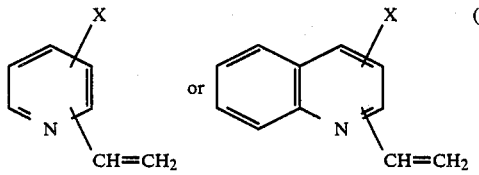

(Mc)

wherein X represents a hydrogen atom, a substituted or unsubstituted alkyl group or a halogen atom, (b) an acrylic ester and (c) acrylonitrile.

(5) Water-insoluble polymers comprising ⅓ mol per mol of polymer or more of a repeating unit represented by the formula (Md):

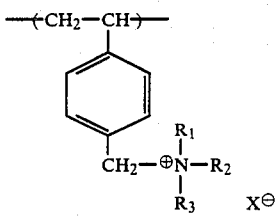

(Md)

wherein $R_1$, $R_2$ and $R_3$ each represents a substituted or unsubstituted alkyl group, with a total carbon atom number thereof being 12 or more; and $X^{\ominus}$ is an anion.

The silver halide which can be used in the present invention is conventional and may be any of silver chloride, silver bromide, silver iodide, silver chlorobromide, silver chloroiodide, silver iodobromide and silver chloroiodobromide.

The silver halide preferably has a mean grain size of not more than 1.0 μm, preferably not more than 0.7 μm. The term "mean grain size" herein used is commonly employed by those skilled in the art and, therefore, can easily be understood. The term "grain size" means a grain diameter when grains are spherical or nearly spherical, or it means an edge length multiplied by $\sqrt{4/\pi}$ when grains are cubic. The mean grain size can be obtained from an algebraic mean or geometrical mean based on a mean grain projected area. Reference can be made to it in Mees and James, *The Theory of the Photographic Process,* 3rd Ed., 36–43, Macmillan Publishing Co. (1966).

In the present invention, it is preferable to use a water-soluble rhodium salt, typically including rhodium chloride, rhodium trichloride, rhodium ammonium chloride, etc. Complex salts of these rhodium salts may also be used. The stage of addition of the rhodium salt is limited to before completion of first ripening in the preparation of emulsions, and preferably during the grain formation. It is preferably added in an amount of from $1\times10^{-8}$ to $1\times10^{-6}$ mol per mol of silver.

In addition, a water-soluble iridium salt, e.g., $Na_3IrCl_6$, $Na_2IrCl_6$, etc., can also be used. The water-soluble iridium salt is preferably added before first ripening in the preparation of emulsions, and more preferably during the grain formation. It is used in an amount of from $1\times10^{-7}$ to $1\times10^{-3}$ mol per mol of silver.

Silver halide grains can be formed by reacting soluble silver salt with soluble halogen salts by a single jet process, a double jet process, a combination thereof, and the like. A method in which silver halide grains are produced in the presence of excess silver ions (the so-called reverse mixing method) can also be employed. Further, the so-called controlled double jet process, in which the pAg of the liquid phase wherein silver halide grains are to be precipitated is maintained constant, may be used. According to this process, silver halide emulsions in which grains have a regular crystal form and an almost uniform size distribution can be obtained.

The silver halide emulsion to be used in the present invention may or may not be chemically sensitized. Chemical sensitization is usually carried out by sulfur sensitization, reduction sensitization, noble metal sensitization or combinations thereof. In some detail, chemical sensitizers used for chemical sensitization include sulfur sensitizers, such as allyl thiocarbamide, thiourea, thiosulfates, thioethers, cystine, etc.; noble metal sensitizers, such as potassium chloroaurate, aurous compounds, potassium chloropalladate, etc.; reduction sensitizers, such as tin chloride, phenylhydrazine, reductone, etc.; and the like.

When silver halide emulsions are infrared-sensitized, solubility of the emulsion in a solution state may sometimes be deteriorated. In order to prevent this, addition of a water-soluble bromide to the emulsions is effective. The water-soluble bromide includes various compounds capable of being dissociated into a bromine ion in water, such as bromine salts of ammonium, potassium, sodium, lithium, etc. Appropriate organic bromides, e.g., tetraethylammonium bromide, ethyl pyridinium bromide, etc., may also be used. Among bromine salts, since cadmium bromide, zinc bromide, etc., are excessively harmful to human body, the above-mentioned harmless water-soluble bromides are desirable.

The amount of the water-soluble bromide to be added to an emulsion is such that sensitivity of the emulsion can substantially be increased and/or variation of sensitivity with time can substantially be prevented. Although such an amount can widely be varied, excellent results can be attained with amounts of from 0.0003 to 0.01 mol per mol of silver, and particularly from 0.0005 to 0.005 mol per mol of silver.

The water-soluble bromide is added to any optional stage after formation of silver halide grains. When chemical sensitization is carried out, it is preferably added after completion of the chemical sensitization.

During the formation of silver halide grains, a silver halide solvent may be used in order to control grain growth. The silver halide solvent to be used includes, for example, ammonia, potassium thiocyanate, ammonium thiocyanate, thioether compounds as described, e.g., in U.S. Pat. Nos. 3,271,157, 3,574,628, 3,794,130, 4,297,439 and 4,276,374; thione compounds as described, e.g., in Japanese Patent Application (OPI) Nos. 144319/78, 82408/78 and 77737/80; amine compounds as described; e.g., in Japanese Patent Application (OPI) No. 100717/79; and the like.

The silver halide emulsion according to the present invention is subjected to infrared sensitization so as to have a sensitivity maximum at a wavelength longer than 750 nm. Any conventional infrared sensitizing dye may be employable, but tricarbocyanine dyes and/or 4-quinoline nucleus-containing dicarbocyanine dyes are particularly preferred from the standpoint of sensitizing capability and stability.

Among the tricarbocyanine dyes which can be used in the present invention, the particularly useful are those represented by the formula (IIIa) or (IIIb):

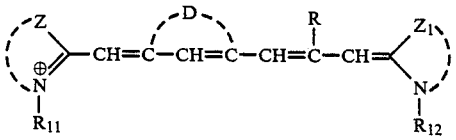
(IIIa)

$(X^{\ominus})_{n-1}$

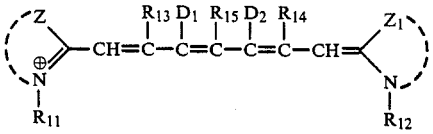
(IIIb)

$(X^{\ominus})_{n-1}$ wherein $R_{11}$ and $R_{12}$ (which may be the same or different) each represents an alkyl group (preferably having 1 to 8 carbon atoms, e.g., a methyl group, an ethyl group, a propyl group, a butyl group, a pentyl group, a heptyl group, etc.) or a substituted alkyl group having 1 to 6 carbon atoms in its alkyl moiety; R represents a hydrogen atom, a methyl group, a methoxy group or an ethoxy group; $R_{13}$ and $R_{14}$ each represents a hydrogen atom, a lower alkyl group preferably having 1 to 4 carbon atoms (e.g., a methyl group, an ethyl group, a propyl group, etc.), a lower alkoxy group (e.g., a methoxy group, an ethoxy group, a propoxy group, a butoxy group, etc.), a phenyl group or a benzyl group; $R_{15}$ represents a hydrogen atom, a lower alkyl group having preferably 1 to 4 carbon atoms (e.g., a methyl group, an ethyl group, a propyl group, etc.), a lower alkoxy group (e.g., a methoxy group, an ethoxy group, a propoxy group, a butoxy group, etc.), a phenyl group, a benzyl group or

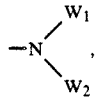

wherein $W_1$ and $W_2$ each represents a substituted or unsubstituted alkyl group having 1 to 18 carbon atoms, and preferably 1 to 4 carbon atoms, in its alkyl moiety (e.g., a methyl group, an ethyl group, a propyl group, a butyl group, a benzyl group, a phenylethyl group, etc.) or an aryl group (e.g., a phenyl group, a naphthyl group, a tolyl group, a p-chlorophenyl group, etc.), or $W_1$ and $W_2$ together form a 5- or 6-membered nitrogen-containing heterocyclic ring; D represents a divalent atomic group necessary to form a substituted or unsubstituted ethylenic linkage, e.g., ethylene or triethylene (the substituent includes one or more of an alkyl group having 1 to 4 carbon atoms, e.g., a methyl group, an ethyl group, a propyl group, an isopropyl group, a butyl group, etc., a halogen atom, e.g., a chlorine atom, a bromine atom, etc., an alkoxy group having 1 to 4 carbon atoms, e.g., a methoxy group, an ethoxy group, a propoxy group, an isopropoxy group, a butoxy group, etc., and the like); $D_1$ and $D_2$ each represents a hydrogen atom, or $D_1$ and $D_2$ together form an ethylenic linkage having the same meaning as defined for D; Z and $Z_1$ each represents a non-metallic atomic group necessary to form a 5- or 6-membered nitrogen-containing heterocyclic ring; $X^{\ominus}$ represents an acid anion; and n represents 1 or 2.

In formulae (IIIa) and (IIIb), the substituent for the substituted alkyl group as represented by $R_{11}$ or $R_{12}$ includes a carboxyl group, a sulfo group, a cyano group, a halogen atom (e.g., a fluorine atom, a chlorine atom, a bromine atom, etc.), a hydroxyl group, an alkoxycarbonyl group having up to 8 carbon atoms (e.g., a methoxycarbonyl group, an ethoxycarbonyl group, a benzyloxycarbonyl group, etc.), an alkoxy group having up to 7 carbon atoms (e.g., a methoxy group, an ethoxy group, a propoxy group, a butoxy group, a benzyloxy group, etc.), an aryloxy group (e.g., a phenoxy group, a p-tolyloxy group, etc.), an acyloxy group having up to 3 carbon atoms (e.g., an acetyloxy group, a propionyloxy group, etc.), an acyl group having up to 8 carbon atoms (e.g., an acetyl group, a propionyl group, a benzoyl group, a mesyl group, etc.), a carbamoyl group (e.g., a carbamoyl group, an N,N-dimethylcarbamoyl group, a morpholinocarbamoyl group, a piperidinocarbamoyl group, etc.), a sulfamoyl group (e.g., a sulfamoyl group, an N,N-dimethylsulfamoyl group, a morpholinosulfamoyl group, etc.), an aryl group (e.g., a phenyl group, a p-hydroxyphenyl group, a p-carboxyphenyl group, a p-sulfophenyl group, an α-naphthyl group, etc.), and the like.

The 5- or 6-membered nitrogen-containing heterocyclic ring formed by Z or $Z_1$ includes a thiazole ring, e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.; a selenazole ring, e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.; an oxazole ring, e.g., a benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.; a quinoline ring, e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.; a 3,3-dialkylindolenine ring, e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.; an imidazole ring, e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-methyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole, etc.; a pyridine ring, e.g., pyridine, 5-methyl-2-pyridine, 3-methyl-4-pyridine, etc.; and the like. Of these, preferred rings are thiazole and oxazole rings, and more preferred rings are benzothiazole, naphthothiazole, naphthoxazole and benzoxazole rings.

Among the aforesaid 4-quinoline nucleus-containing dicarbocyanine dyes which can be used in the present invention, particularly useful dyes are those represented by the formula (IIIc):

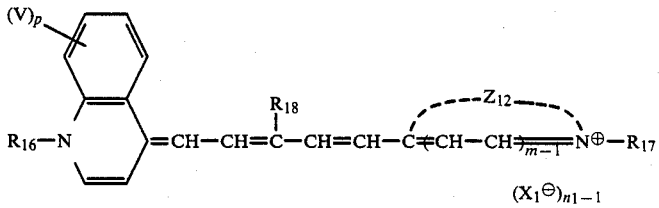

(IIIc)

wherein $R_{16}$ and $R_{17}$ have the same meaning as $R_{11}$ and $R_{12}$ of the formula (IIIb), respectively; $R_{18}$ has the same meaning as $R_{13}$ of the formula (IIIb) (preferably a lower alkyl group or a benzyl group); V represents a hydrogen atom, a lower alkyl group preferaby having 1 to 4 carbon atoms (e.g, a methyl group, an ethyl group, a propyl group, etc.), an alkoxy group (e.g., a methoxy group, an ethoxy group, a butoxy group, etc.), a halogen atom (e.g., a fluorine atom, a chlorine atom, etc.) or a substituted alkyl group (e.g., a trifluoromethyl group, a carboxymethyl group, etc.); $Z_{12}$ has the same meaning as Z or $Z_1$ of the formula (IIIa) or (IIIb); $X_1^{\ominus}$ has the same meaning as $X^{\ominus}$ of the formula (IIIa) or (IIIb); and m, $n_1$ and p each represents 1 or 2.

Specific examples of the sensitizing dyes which can be used in the present invention are shown below, but the present invention is not deemed to be limited thereto:

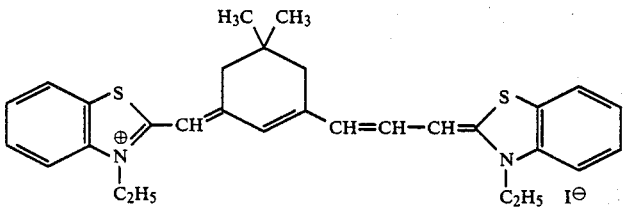

III-1

-continued
III-2
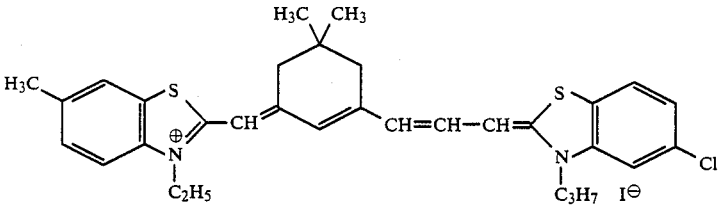
III-3
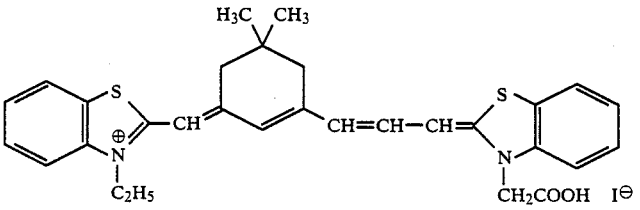
III-4
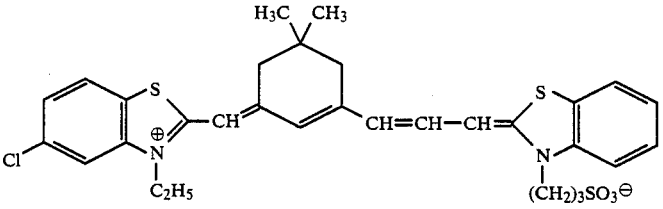
III-5
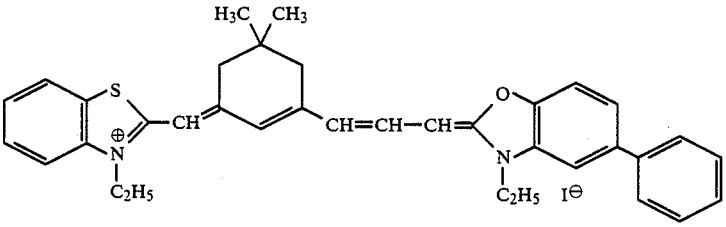
III-6
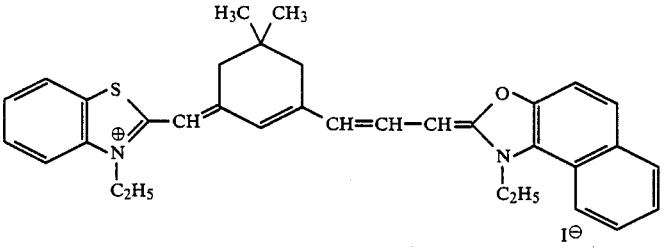
III-7
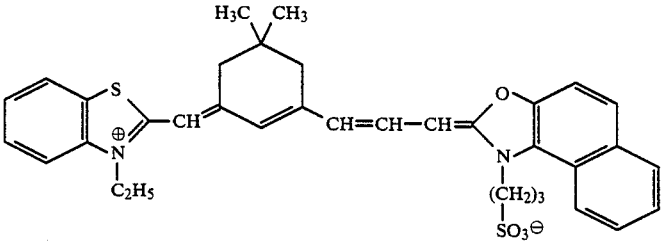
III-8
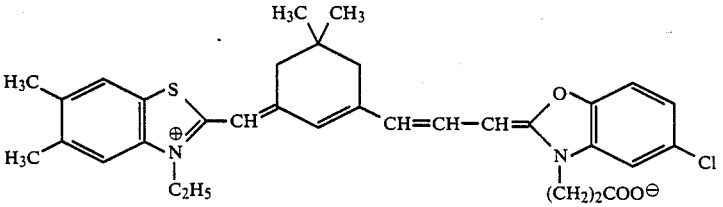

-continued
III-9
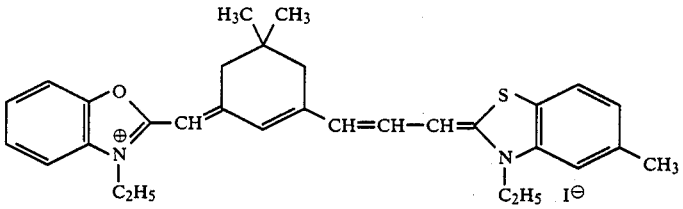
III-10
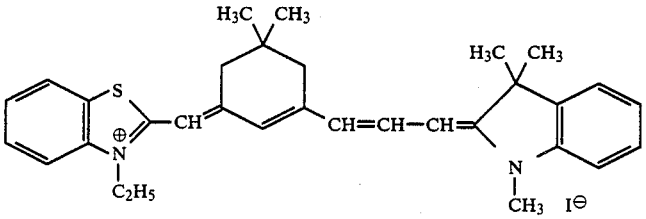
III-11
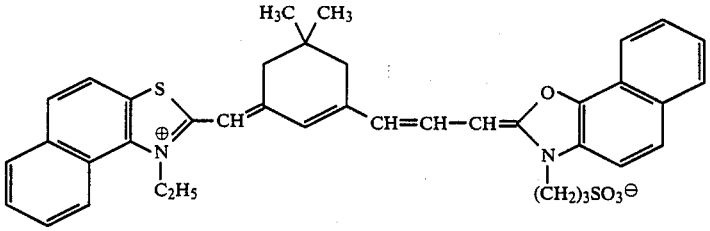
III-12
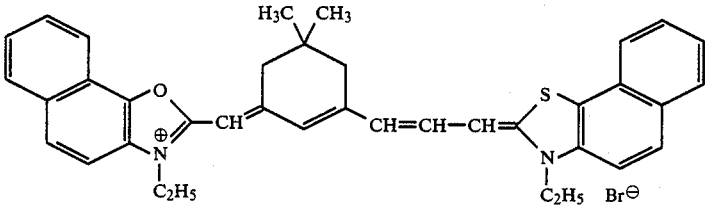
III-13
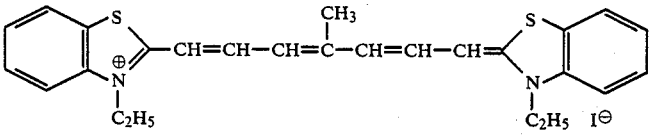
III-14
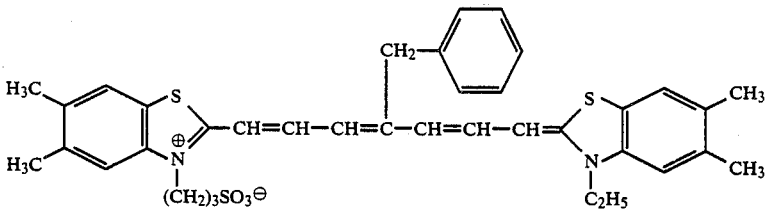
III-15
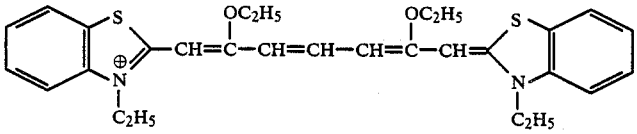
III-16
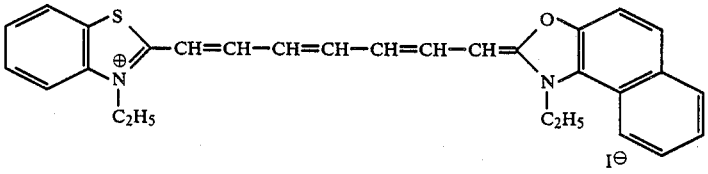

-continued
III-17
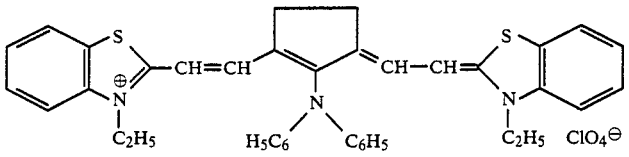
III-18
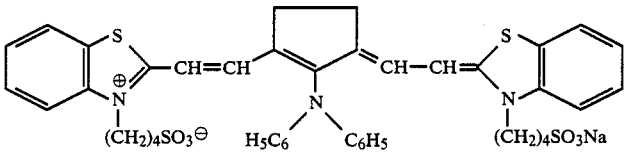
III-19
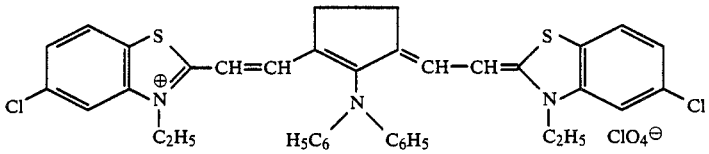
III-20
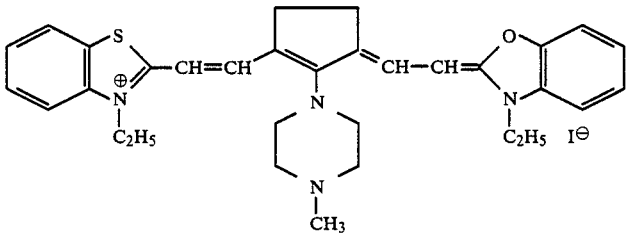
III-21
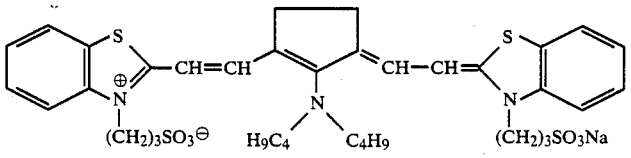
III-22
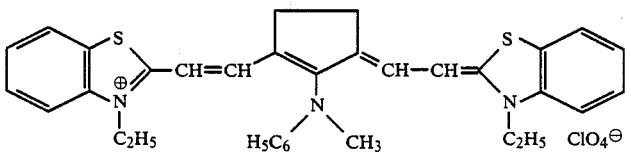
III-23
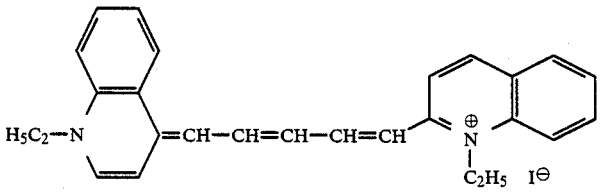
III-24
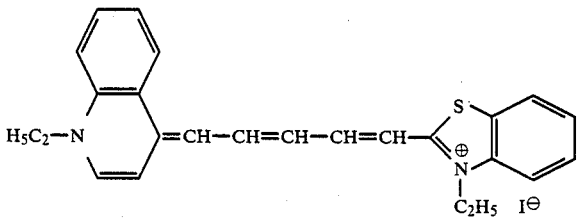

-continued
III-25
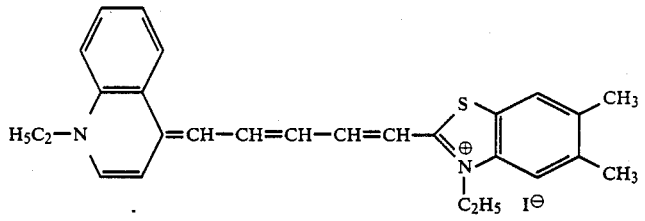
III-26
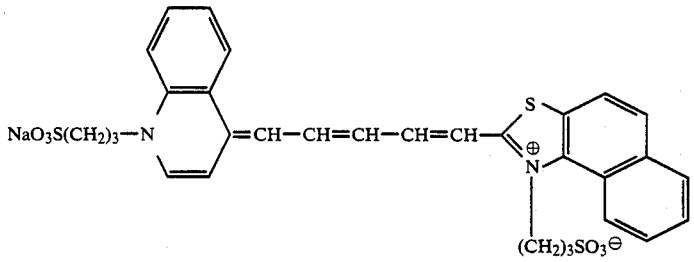
III-27
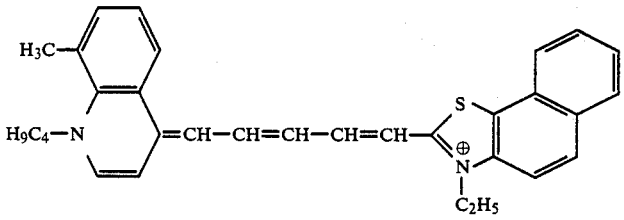
III-28
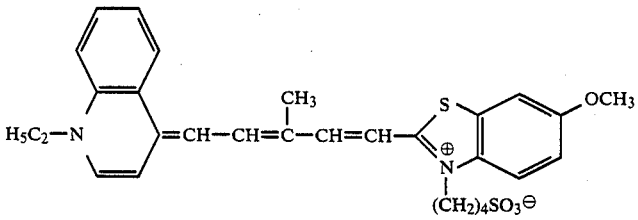
III-29
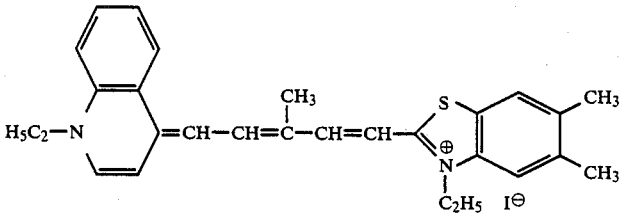
III-30
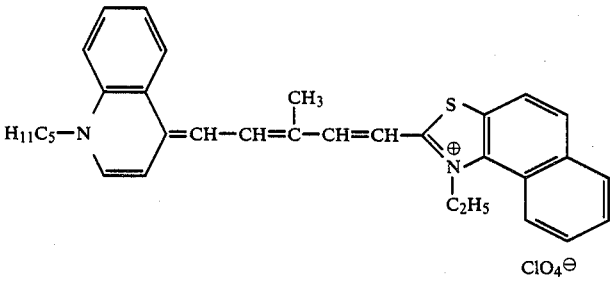

-continued
III-31
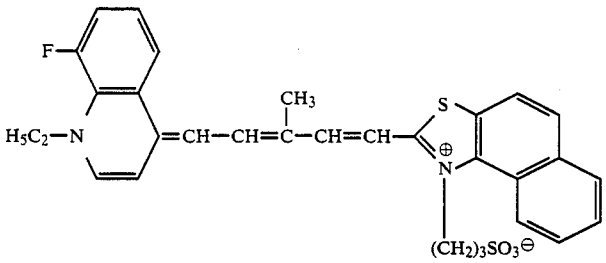
III-32
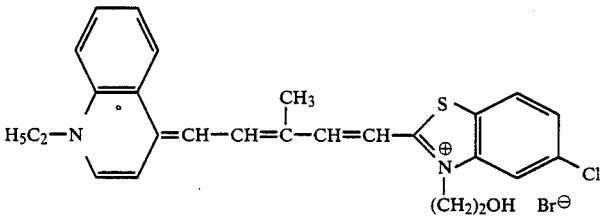
III-33
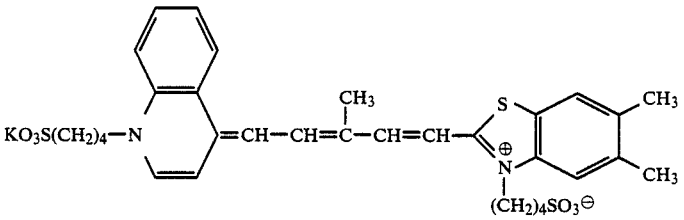
III-34
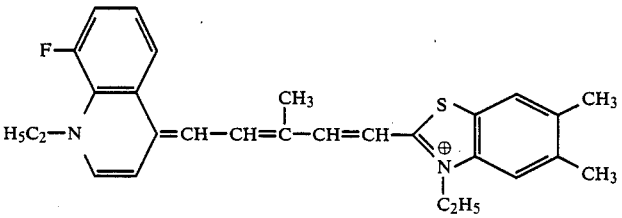
III-35
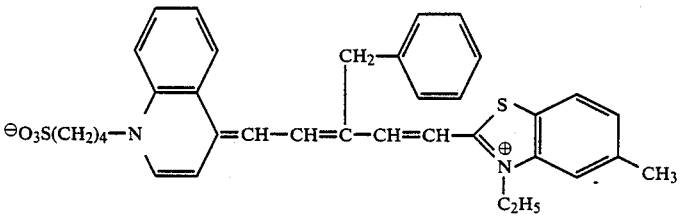
III-36
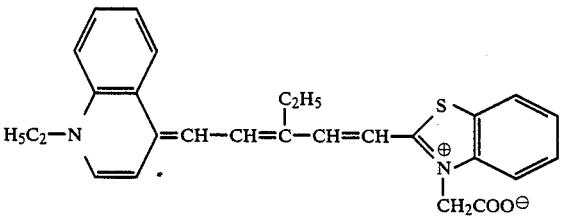
III-37
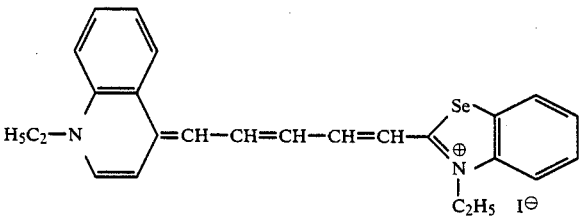

-continued

III-38

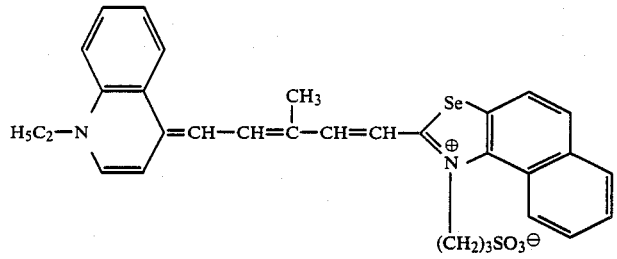

III-39

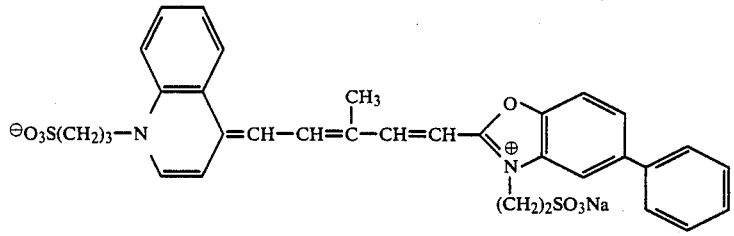

III-40

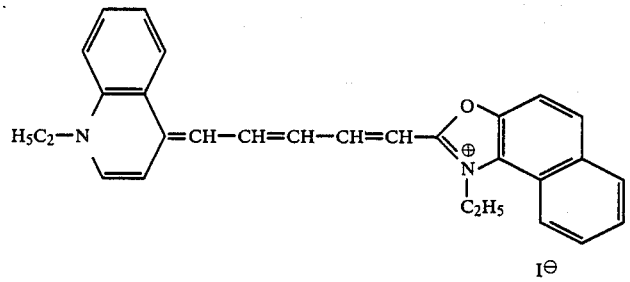

III-41

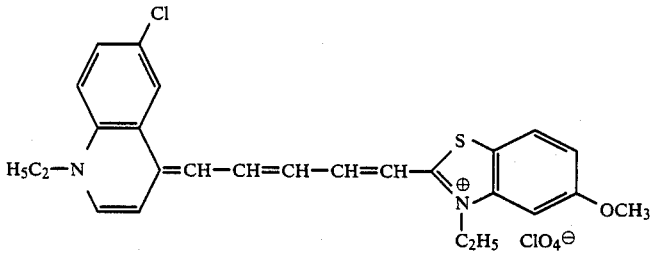

III-42

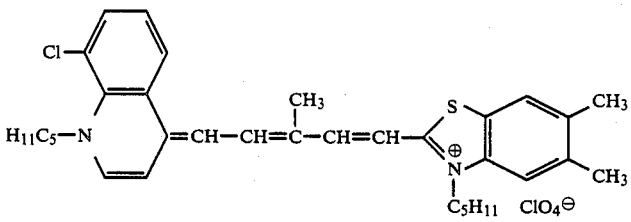

These infrared sensitizing dyes are generally incorporated in a silver halide photographic emulsion in an amount of from $5\times10^{-7}$ to $5\times10^{-3}$ mol, preferably from $1\times10^{-6}$ to $1\times10^{-3}$ mol, and more preferably from $2\times10^{-6}$ to $5\times10^{-4}$ mol, per mol of silver halide.

The infrared sensitizing dye according to the present invention can be dispersed directly in an emulsion, or can be dissolved, in an appropriate solvent, e.g., methanol, ethanol, methyl cellosolve, acetone, water, pyridine or mixtures thereof, and then added to an emulsion in the form of a solution. For dissolving the dye, ultrasonic waves can be utilized. Additional methods for incorporating the infrared sensitizing dye in an emulsion include a method comprising dissolving a dye in a volatile organic solvent, dispersing the dye solution in a hydrophilic colloid and adding the dispersion to an emulsion as described, e.g., in U.S. Pat. No. 3,469,987; a method comprising dispersing a water-insoluble dye in a water-soluble solvent without dissolution, and adding the dispersion to an emulsion as described, e.g., in Japanese Patent Publication No. 24185/71; a method comprising dissolving a dye in a surface active agent and adding the solution to an emulsion as described in U.S. Pat. No. 3,822,135; a method comprising dissolving a dye in a compound for red shifting and adding the solution to an emulsion as described in Japanese patent application (OPI) No. 74624/76; and a method comprising dissolving a dye in an acid substantially free from water and adding the solution to an emulsion as described in Japanese patent application (OPI) No. 80826/75. Further, methods described in U.S. Pat. Nos. 2,912,343, 3,342,605, 2,996,287 and 3,429,835 may also be employed for the incorporation of infrared sensitizing dyes into an emulsion. The infrared sensitizing dye may either be uniformly dispersed in a silver halide emulsion immediately before coating onto a support or be dispersed therein at any stage during the preparation of the emulsion.

The above-described sensitizing dyes according to the present invention can be employed in combination with other known sensitizing dyes, such as those described in U.S. Pat. Nos. 3,703,377, 2,688,545, 3,397,060, 3,615,635 and 3,628,964, British Pat. Nos. 1,242,588 and 1,293,862, Japanese Patent Publication Nos. 4936/68, 14030/69 and 10773/68, U.S. Pat. No. 3,416,927, Japanese Patent Publication No. 4930/68 and U.S. Pat. Nos. 3,615,613, 3,615,632, 3,617,295 and 3,635,721.

In the present invention, compounds that can be used for the purpose of enhancing a supersensitization effect and/or preservability include those represented by formula (IV)

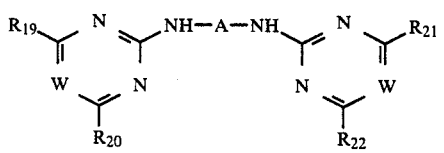

(IV)

wherein —A— represents a divalent aromatic residue containing or not containing an —SO M group, wherein M represents a hydrogen atom or a water solubility imparting cation, e.g., sodium, potassium, etc.; $R_{19}$, $R_{20}$, $R_{21}$ and $R_{22}$ (which may be the same or different) each represents a hydrogen atom, a hydroxyl group, a lower alkyl group (preferably the one containing from 1 to 8 carbon atoms, e.g., a methyl group, an ethyl group, an n-propyl group, an n-butyl group, etc.), an alkoxy group (preferably the one containing from 1 to 8 carbon atoms, e.g., a methoxy group, an ethoxy group, a propoxy group, a butoxy group, etc.), an aryloxy group (e.g., a phenoxy group, a naphthoxy group, an o-tolyloxy group, a p-sulfophenoxy group, etc.), a halogen atom (e.g., a chlorine atom, a bromine atom, etc.), a heterocyclic ring (e.g., a morpholinyl group, a piperidyl group, eec.), an alkylthio group (e.g., a methylthio group, an ethylthio group, etc.), a heterocyclic thio group (e.g., a benzothiazolylthio group, a benzimidazolylthio group, a phenyltetrazolylthio group, etc.), an arylthio group (e.g., a phenylthio group, a tolylthio group, etc.), an amino group, an alkylamino or substituted alkylamino group (e.g., a methylamino group, an ethylamino group, a propylamino group, a dimethylamino group, a diethylamino group, a dodecylamino group, a cyclohexylamino group, a β-hydroxyethylamino group, a di(β-hydroxyethyl)amino group, a β-sulfoethylamino group, etc.), an arylamino or substituted arylamino group (e.g., an anilino group, an o-sulfoanilino group, an m-sulfoanilino group, a p-sulfoanilino group, an o-toluidino group, an m-toluidino group, a p-toluidino group, an o-carboxyanilino group, an m-carboxyanilino group, a p-carboxyanilino group, an o-chloroanilino group, an m-chloroanilino group, a p-chloroanilino group, a p-aminoanilino group, an o-anisidino group, an m-anisidino group, a p-anisidino group, an o-acetaminoanilino group, a hydroxyanilino group, a disulfophenylamino group, a naphthylamino group, a sulfonaphthylamino group, etc.), a heterocyclic amino group (e.g., a 2-benzothiazolylamino group, a 2-pyrazylamino group, etc.), a substituted or unsubstituted aralkylamino group (e.g., a benzylamino group, an o-anisylamino group, an m-anisylamino group, a p-anisylamino group, etc.), an aryl group (e.g., a phenyl group, etc.) or a mercapto group; when —A— does not contain an —SO M group, at least one of $R_{19}$, $R_{20}$, $R_{21}$ and $R_{22}$ contains at least one —SO M group; and W represents —CH= or —N=, and preferably —CH=.

In formula (IV), —A— is preferably selected from the following groups of $—A_1—$ and $—A_2—$, provided that —A— is selected from the group of $—A_1—$ when one of $R_{19}$, $R_{20}$, $R_{21}$ and $R_{22}$ contains an $—SO_3M$ group.

$—A_1—$ represents the following groups:

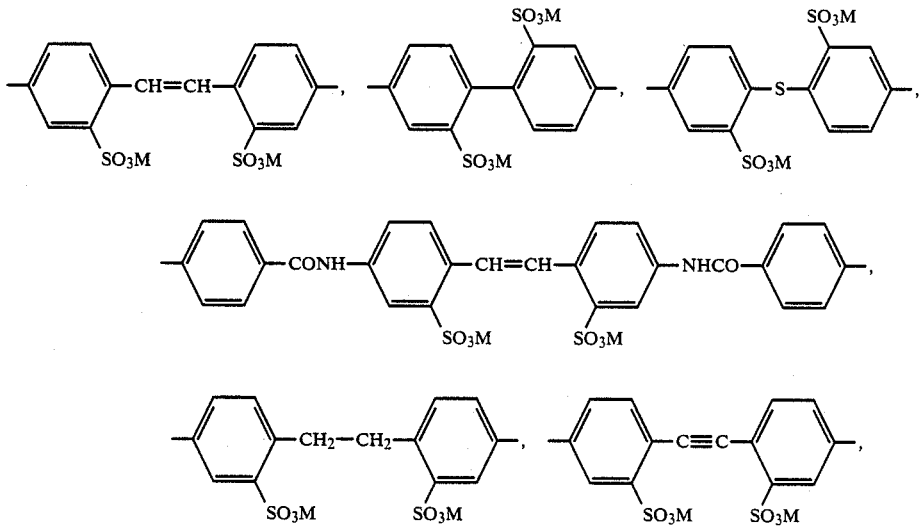

-continued

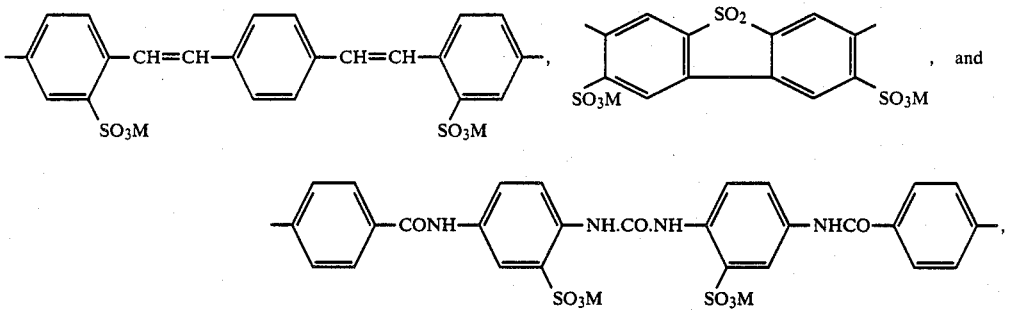

—$A_2$— represents the groups:

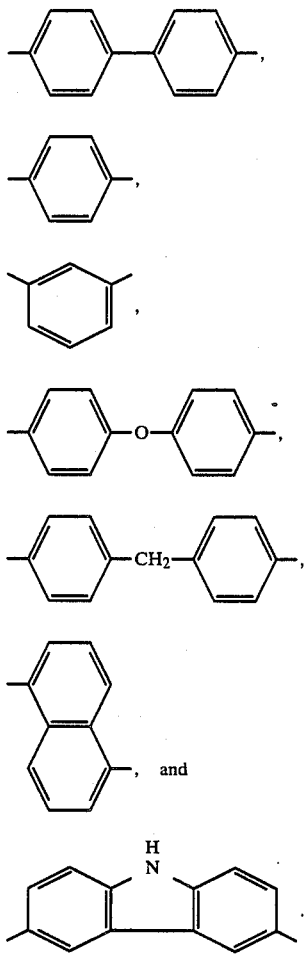

Specific examples of the compounds represented by the formula (IV) are shown below, but the present invention is not limited thereto.

| | |
|---|---|
| IV-1 | Disodium 4,4'-bis[4,6-di(benzothiazolyl-2-thio)-pyrimidin-2-ylamino]stilbene-2,2'-disulfonate |
| IV-2 | Disodium 4,4'-bis[4,6-di(benzothiazolyl-2-amino)-pyrimidin-2-ylamino]stilbene-2,2'-disulfonate |
| IV-3 | Disodium 4,4'-bis[4,6-di(naphthyl-2-oxy)pyrimidin-2-ylamino]stilbene-2,2'-disulfonate |
| IV-4 | Disodium 4,4'-bis[4,6-di(naphthyl-2-oxy)pyrimidin-2-ylamino]bibenzyl-2,2'-disulfonate |
| IV-5 | Disodium 4,4'-bis(4,6-dianilinopyrimidin-2-ylamino)stilbene-2,2'-disulfonate |
| IV-6 | Disodium 4,4'-bis[4-chloro-6-(2-naphthyloxy)-pyrimidin-2-ylamino]biphenyl-2,2'-disulfonate |
| IV-7 | Disodium 4,4'-bis[4,6-di(1-phenyltetrazolyl-5-thio)pyrimidin-2-ylamino]stilbene-2,2'-disulfonate |
| IV-8 | Disodium 4,4'-bis[4,6-di(benzimidazolyl-2-thio)-pyrimidin-2-ylamino]stilbene-2,2'-disulfonate |
| IV-9 | Disodium 4,4'-bis(4,6-diphenoxypyrimidin-2-ylamino)stilbene-2,2'-disulfonate |
| IV-10 | Disodium 4,4'-bis(4,6-diphenylthiopyrimidin-2-ylamino)stilbene-2,2'-disulfonate |
| IV-11 | Disodium 4,4'-bis(4,6-dimercaptopyrimidin-2-ylamino)biphenyl-2,2'-disulfonate |
| IV-12 | Disodium 4,4'-bis(4,6-dianilinotriazin-2-ylamino)-stilbene-2,2'-disulfonate |
| IV-13 | Disodium 4,4'-bis(4-anilino-6-hydroxytriazin-2-ylamino)stilbene-2,2'-disulfonate |
| IV-14 | Disodium 4,4'-bis(4-naphthylamino-6-anilino-triazin-2-ylamino)stilbene-2,2'-disulfonate |

Preferred among the foregoing are IV-1 to IV-12, and more preferred are IV-1 to IV-5 and IV-7.

The compound of the formula (IV) is advantageously used in an amount of from about 0.01 to 5 g per mol of silver halide in an emulsion.

The above-described infrared sensitizing dye and the aforesaid compound of the formula (IV) are advantageously used in a weight proportion of from 1/1 to 1/100, and preferably from 1/2 to 1/50.

The compound of the formula (IV) can be dispersed directly in an emulsion or once dissolved in an appropriate solvent, e.g., methanol, ethanol, methyl cellosolve, water, etc., or a mixture thereof, and added to an emulsion. Incorporation of the compound (IV) to an emulsion can also be carried out in the form of either a solution or a dispersion in a colloid in the same manner as described for the incorporation of the sensitizing dyes. The method disclosed in Japanese Patent Application (OPI) No. 80119/75 may also be used.

In the present invention, compounds represented by the following formula (V) can also be used in combination:

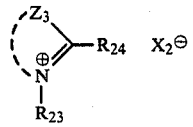

(V)

wherein $Z_3$ represents a non-metallic atomic group necessary to form a 5- or 6-membered nitrogen-containing heterocyclic ring; $R_{23}$ represents a hydrogen atom, an alkyl group having up to 8 carbon atoms (e.g., a methyl group, an ethyl group, a propyl group, a butyl group, a pentyl group, etc.) or an alkenyl group (e.g., an allyl group, etc.); $R_{24}$ represents a hydrogen atom or a lower alkyl group (e.g., a methyl group, an ethyl group, etc.); and $X_2\ominus$ represents an acid anion (e.g., $Cl\ominus$, $Br\ominus$, $I\ominus$, $ClO_4\ominus$, p-toluenesulfonic acid residue, etc.).

In the above formula (V), the nitrogen-containing heterocyclic ring formed by $Z_3$ includes a thiazolium ring, e.g., 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium, etc.; an oxazolium ring, e.g., oxazolium, 4-methyloxazolium, benzoxazolium, 5-chlorobenzoxazolium, 5-phenylbenzoxazolium, 5-methylbenzoxazolium, naphtho[1,2-d]oxazolium, etc.; an imidazolium ring, e.g., 1-methylbenzimidazolium, 1-propyl-5-chlorobenzimidazolium, 1-ethyl-5,6-dichlorobenzimidazolium, 1-allyl-5-trichloromethyl-6-chlorobenzimidazolium, etc.; a selenazolium ring, e.g., benzoselenazolium, 5-chlorobenzoselenazolium, 5-methylbenzoselenazolium, 5-methoxybenzoselenazolium, naphtho[1,2-d]selenazolium, etc.; and the like. Of these, thiazolium rings are preferred, with more preferred being substituted or unsubstituted benzothiazolium and naphthothiazolium rings.

Specific examples of the compounds represented by the formula (V) are shown below, but the present invention is not deemed to be limited thereto.

V-1

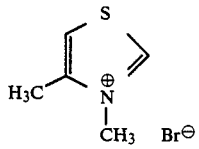

V-2

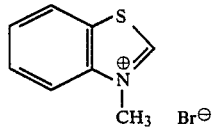

V-3

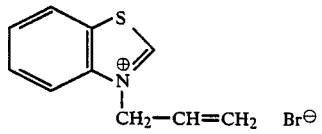

V-4

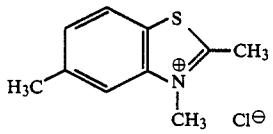

V-5

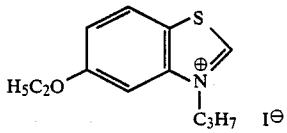

V-6

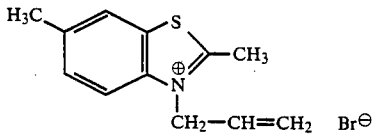

-continued

V-7

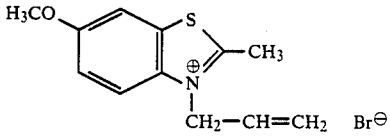

V-8

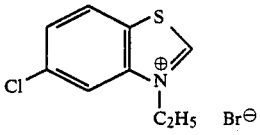

V-9

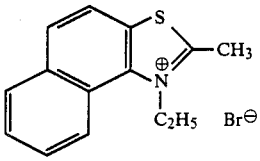

V-10

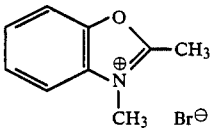

V-11

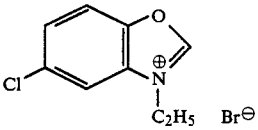

V-12

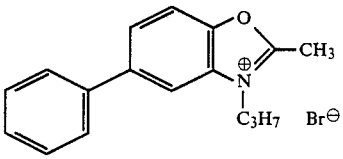

V-13

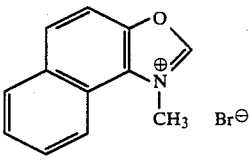

V-14

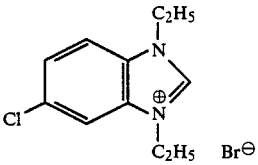

V-15

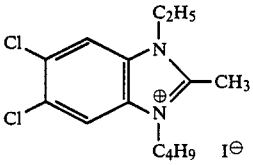

V-16

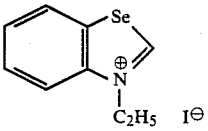

-continued

V-17

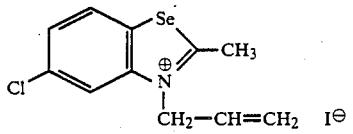

V-18

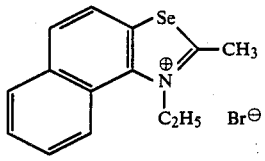

The compound represented by formula (V) is advantageously used in an amount of from about 0.01 to 5 g per mol of silver halide in an emulsion.

The aforesaid infrared sensitizing dye of the present invention and the compound of formula (V) are advantageously used in a weight ratio range of from 1/1 to 1/300, and more advantageously from 1/2 1/50.

The compound of the formula (V) can be incorporated in an emulsion either by directly dispersing in the emulsion or by once dissolving in an appropriate solvent, e.g., water, methanol, ethanol, propanol, methyl cellosolve, acetone, etc., or a mixture thereof, and then adding to an emulsion. It can also be incorporated in an emulsion in the form of a solution or a dispersion in a colloid according to the methods as described with respect to the incorporation of sensitizing dyes in an emulsion.

The compound represented by formula (V) may be added to an emulsion either before or after the addition of the above-described infrared sensitizing dye. Further, the compound of formula (V) and the infrared sensitizing dye may be simultaneously added to an emulsion either in the form of separate solutions or in the form of a mixture thereof.

The photographic emulsion of the present invention can contain a wide variety of known compounds for the purpose of preventing sensitivity reduction or fog generation during the preparation, preservation or processing the light-sensitive material. Such compounds include various heterocyclic compounds, mercury-containing compounds, mercapto compounds, metal salts, and the like, such as nitrobenzimidazole, ammonium chloroplatinate, 4-hydroxy-6-methyl-1,3,3a,7-tetraazaindene, 1-phenyl-5-mercaptotetrazole, and so on. References of specific examples of usable compounds are cited in Mees and James, *The Theory of the Photographic Process,* 3rd Ed., 344–349 (1966). Additional examples of these compounds are thiazolium salts described in U.S. Pat. Nos. 2,131,038 and 2,694,716; azaindenes descirbed in U.S. Pat. Nos. 2,886,437 and 2,444,605; urazols described in U.S. Pat. No. 3,287,135, etc., sulfocatechols described in U.S. Pat. No. 3,236,652, etc.; oximes described in British Pat. No. 623,448; mercaptotetrazoles, nitron and nitroindazoles described in U.S. Pat. Nos. 2,403,927, 3,266,897 and 3,397,987; polyvalent metal salts described in U.S. Pat. No. 2,893,405, etc.; thiuronium salts described in U.S. Pat. No. 3,220,839, etc.; salts of palladium, platinum or gold described in U.S. Pat. Nos. 2,566,263 and 2,597,915, etc.; and the like.

The silver halide photographic emulsion can contain a developing agent or agents, such as hydroquinones, catechols, aminophenols, 3-pyrazolidones, ascorbic acid or derivatives thereof, reductones, and phenylenediamines. These developing agents can be incorporated in a silver halide emulsion layer and/or other photographic layers, such as a protective layer, an intermediate layer, a filter layer, an antihalation layer, a backing layer, and the like. The developing agent can be incorporated to these layers in the form of a solution in an appropriate solvent or in the form of a dispersion as described in U.S. Pat. No. 2,592,368 or French Pat. No. 1,505,778.

Development accelerators which can be used include those described, e.g., in U.S. Pat. Nos. 3,288,612, 3,333,959, 3,345,175 and 3,708,303, British Pat. No. 1,098,748 and West German Pat. Nos. 1,141,531 and 1,183,784, etc.

The photographic emulsion of this invention can contain an organic or inorganic hardener. Examples of usable hardeners include chromium salts, e.g., chromium alum, chromium acetate, etc., aldehydes, e.g., formaldehyde, glyoxal, glutaraldehyde, etc., N-methylol compounds, e.g., dimethylolurea, methyloldimethylhydantoin, etc., dioxane derivatives, e.g., 2,3-dihydroxydioxane, etc., active vinyl compounds, e.g., 1,3,5-triacryloyl-hexahydro-s-triazine, bis(vinylsulfonyl)methyl ether, N,N'-methylenebis[β-(vinylsulfonyl)propionamide], etc., active halogen compounds, e.g., 2,4-dichloro-6-hydroxy-s-triazine, etc., mucohalogenic acids, e.g., mucochloric acid, mucophenoxychloric acid, etc., isooxazole, dialdehyde starch, 2-chloro-6-hydroxytriazinylated gelatin, and the like, either alone or in combination thereof. Specific examples of these hardeners are described, e.g., in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427, Japanese Patent Publication Nos. 7133/59 and 1872/71, etc.

The photographic emulsion layer or other hydrophilic colloidal layers of the light-sensitive materials according to the present invention can further contain a wide variety of surface active agents for various purposes, for example, coating aid, prevention of static charge, improvement in slipperiness, emulsification and dispersing, prevention of adhesion, improvement in photographic properties, and the like.

Examples of the surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or aryl ethers, polyethylene glycol esters, polyethylene glycol surbitan esters, polyalkylene glycol alkylamines or amides, polyethylene oxide adducts of silicone, etc.), glycidol derivatives (e.g., alkenylsuccinic polyglycerides, alkylphenol polyglycerides, etc.), fatty acid esters of polyhydric alcohols, alkyl esters of sugars, and the like; anionic surface active agents containing an acidic group, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

In the case where a mordant is used, it is preferable to use a combination of an anionic surface active agent and an amphoteric surface active agent in order to facilitate coating and to improve mordanting property. These surface active agent may be added to either a coating composition for a light-insensitive hydrophilic colloidal layer or a coating composition for an emulsion layer. The amounts and proportions of these surface active agents to be used are optional, and optimum amount can be conventionally determined.

The anionic group of the anionic surface active agents includes a sulfo group, a carboxyl group, a phospho group, etc., as above mentioned, and the hydrophobic moiety includes a hydrocarbon, a partially or entirely fluorinated hydrocarbon, and the like.

Typical examples of the anionic surface active agents which can preferably be used in the present invention are shown below, but the present invention is not deemed to be limited thereto:

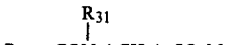
(A-1)

wherein $R_{30}$ represents a saturated or unsaturated hydrocarbon residue having from 3 to 20 carbon atoms or a saturated or unsaturated fluorine-substituted hydrocarbon residue having from 3 to 20 carbon atoms; $R_{31}$ represents a hydrogen atom, a methyl group, an ethyl group or a propyl group; n represents an integer of from 1 to 20, and preferably from 1 to 8; and M represents a monovalent alkali metal, and preferably sodium or potassium.

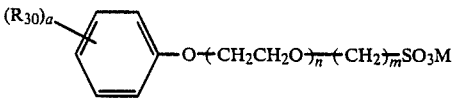
(A-2)

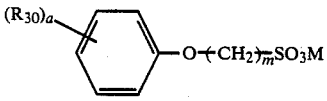
(A-3)

wherein $R_{30}$, M and n are as defined above; a represents 0, 1 or 2; and m represents an integer of from 1 to 6, and preferably from 2 to 4.

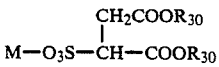
(A-4)

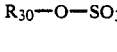
(A-5)

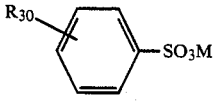
(A-6)

wherein $R_{30}$ and M are as defined above.

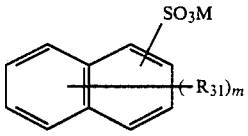
(A-7)

wherein $R_{31}$, M and m are as defined above.

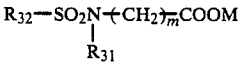
(A-8)

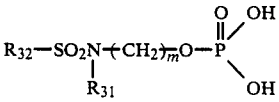
(A-9)

wherein $R_{32}$ represents a saturated or unsaturated hydrocarbon residue having from 3 to 22 carbon atoms, and preferably from 7 to 18 carbon atoms, and having its hydrogen moieties fluorinated; and $R_{31}$ and m are as defined above.

Specific examples of the anionic surface active agents which are particularly preferred in the present invention are shown below:

$C_{11}H_{23}CONHCH_2SO_3Na$ A-1

$C_7H_{15}CONH(CH_2)_2SO_3Na$ A-2

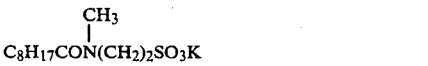
A-3

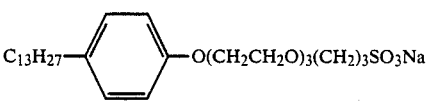
A-4

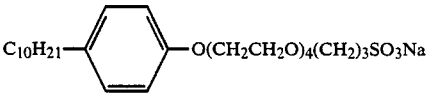
A-5

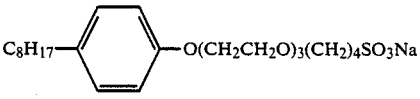
A-6

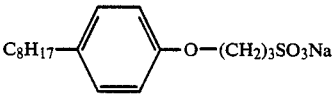
A-7

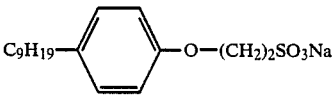
A-8

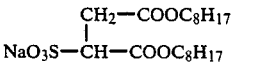
A-9

$C_7H_{15}-O-SO_3K$ A-10

$C_{12}H_{25}O-SO_3Na$ A-11

-continued

A-12

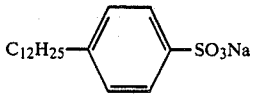

A-13 $C_8F_{17}—SO_2NH(CH_2)_3COONa$

A-14 $C_{17}F_{33}SO_2NH(CH_2)_4COONa$

A-15 $C_{13}F_{27}SO_2NH(CH_2)_3OPO(OH)_2$

A-15

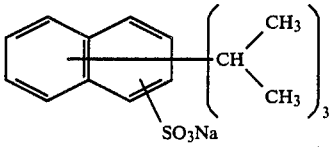

The amphoteric surface active agents to be used in the present invention are compounds in which an anionic group and a cationic group forms an inner salt in the molecule, and can be represented by the formula (B)

$$A^{\ominus}—C^{\oplus} \quad (B)$$

wherein $A^{\ominus}$ represents an anion residue having an anionic group, e.g., a sulfo group, a carboxyl group, a phospho group, etc.; $C^{\oplus}$ represents an organic cation residue.

Specific examples of the amphoteric surface active agents which can particularly preferably be used in the present invention are shown below:

| | |
|---|---|
| B-1 | (10-Carboxydecyl)dimethyldodecylammonium hydroxide |
| B-2 | (2-Carboxyethyl)dimethyldodecylammonium hydroxide |
| B-3 | (3-Sulfopropyl)dimethyldodecylammonium hydroxide |
| B-4 | (4-Sulfobutyl)diethyldodecylammonium hydroxide |
| B-5 | (2-Carboxyethyl)dimethyloctadecylammonium hydroxide |
| B-6 | (3-Sulfopropyl)dimethyloctadecylammonium hydroxide |
| B-7 | (Carboxymethyl)dimethyloctadecylammonium hydroxide |
| B-8 | (Carbomethyl)dimethylundecylcarbamoylpropyl-ammonium hydroxide |
| B-9 | (3-Sulfobutyl)dimethylundecylcarbamoylpropyl-ammonium hydroxide |
| B-10 | 1-(10-Carboxydecyl)pyridinium hydroxide |
| B-11 | 1-(10-Sulfatodecyl)pyridinium hydroxide |
| B-12 | 3-Carboxy-1-dodecylpyridinium hydroxide |
| B-13 | 1-(1-Carboxytridecyl)pyridinium hydroxide |

For the purpose of obtaining high quality dot or line images by sharpening the toe of a characteristic curve, it is preferable to use polyalkylene oxide compounds. The polyalkylene oxide compounds include, for example, condensates between a polyalkylene oxide comprising at least 10 units of an alkylene oxide having from 2 to 4 carbon atoms (e.g, ethylene oxide, propylene-1,2-oxide, butylene-1,2-oxide, etc., and preferably ethylene oxide) and a compound having at least one active hydrogen atom (e.g., water, aliphatic alcohols, aromatic alcohols, fatty acids, organic amines, hexitol derivatives, etc.), and block copolymers of two or more polyalkylene oxides. More specifically, the polyalkylene oxide compounds which can be used include polyalkylene glycols, polyalkylene glycol alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block copolymers, polyalkylene glycol graft polymers, and the like. The molecular weight of these polyalkylene oxide compounds should be not less than about 600.

In the polyalkylene oxide compounds, two or more of polyalkylene oxide chains may be present. In this case, the individual polyalkylene oxide chain may comprise less than 10 alkylene oxide units as long as the total number of the alkylene oxide units per molecule is at least 10. The individual polyalkylene oxide chain may be composed of different alkylene oxide units, e.g., an ethylene oxide unit and a propylene oxide unit. The polyalkylene oxide compounds to be used in the present invention preferably contain from 14 to 100 alkylene oxide units per molecule.

Specific examples of the polyalkylene oxide compounds which can be used in this invention are described in Japanese Patent Application (OPI) Nos. 156423/75, 108130/77 and 3217/78. These polyalkylene oxide compounds may be used individually or in combinations of two or more thereof.

The polyalkylene oxide compound can be incorporated in a silver halide emulsion by dissolving it in water or a water-miscible low boiling organic solvent in an appropriate concentration and adding to the solution to the emulsion at an appropriate stage before coating, and preferably after chemical ripening.

These polyalkylene oxide compounds are preferably used in an amount of from $1\times10^{-5}$ mol to $1\times10^{-2}$ mol per mol of silver halide. It is also possible to add the polyalkylene oxide compounds to a light-insensitive hydrophilic colloidal layer, e.g., an intermediate layer, a protective layer, a filter layer, etc., instead of the emulsion layer.

Binders or protective colloids for photographic emulsions include gelatin to advantage, but other hydrophilic colloids may also be employed. Examples of usable hydrophilic colloids include proteins, such as gelatin derivatives, gelatin graft polymers with other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and various synthetic high polymeric substances, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomer units constituting these homopolymers.

Gelatin to be used include not only lime-processed gelatin but acid-processed gelatin. In addition, hydrolysis products or enzymatic decomposition products of gelatin can also be used. The gelatin derivatives include those obtained by reacting gelatin with various compounds, such as acid halides, acid anhydrides, isocyanates, bromoacetic acid, alkanesultones, vinylsulfonamides, maleinimide compounds, polyalkylene oxides, epoxy compounds, etc. Specific examples of the gelatin derivatives are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

The gelatin graft polymers include those obtained by grafting to gelatin a homo- or copolymer of a vinyl type monomer, e.g., acrylic acid, methacrylic acid or derivatives thereof (e.g., esters, amides), acrylonitrile, styrene, etc. In particular, graft polymers obtained by grafting to gelatin a polymer having compatibility with gelatin to some extent, such as a polymer of acrylic acid, methacrylic acid, acrylamide, methacrylamide or hydroxyalkyl methacrylate, are particularly preferred. Examples of the gelatin graft polymers are described in U.S. Pat. Nos. 2,763,625, 2,831,767 and 2,956,884, etc.

Typical examples of the synthetic hydrophilic high polymeric substances which can be used as binders or protective colloids are described, e.g., in West German Patent Application (OLS) No. 2,312,708, U.S. Pat. Nos. 3,620,751 and 3,879,205 and Japanese Patent Publication No. 7561/68.

The photographic emulsion of the present invention may contain a dispersion of a water-insoluble or sparingly water-soluble synthetic polymer for the purpose of improving dimensional stability, and the like. The polymers to be used include polymers comprising monomer component or components selected from, for example, alkyl(meth)acrylates, alkoxyalkyl(meth)acrylate, glycidyl(meth)acrylates, (meth)acrylamides, vinyl esters (e.g., vinyl acetate), acrylonitrile, olefins, styrene, etc., and copolymers comprising such monomer component(s) and monomer component(s) selected from acrylic acid, methacrylic acid, $\alpha,\beta$-unsaturated dicarboxylic acids, hydroxyalkyl (meth)acrylates, sulfoalkyl(meth)acrylates, styrenesulfonic acid, etc. Specific examples of these polymers are described in U.S. Pat. Nos. 2,376,005, 2,739,137, 2,853,457, 3,062,674, 3,411,911, 3,488,708, 3,525,620, 3,607,290, 3,635,715 and 3,645,740 and British Pat. Nos. 1,186,699 and 1,307,373.

The light-sensitive materials according to the present invention can be developed by any known techniques for photographic development. Developing agents to be used in a developer include dihydroxybenzene developing agents, 1-phenyl-3-pyrazolidone developing agents, p-aminophenol developing agents, and the like. These developing agents can be used either individually or in combinations thereof as in a combination of 1-phenyl-3-pyrazolidones and dihydroxybenzenes or a combination of p-aminophenols and dihydroxybenzenes. The light-sensitive materials of this invention may be processed with a so-called infectious developer using a sulfite ion buffer, e.g., carbonyl bisulfite, and hydroquinone.

Examples of the dihydroxybenzene developing agents are hydroquinone, chlorohydroquinone, bromohydroquinone, isopropylhydroquinone, toluhydroquinone, methylhydroquinone, 2,3-dichlorohydroquinone, 2,5-dimethylhydroquinone, and the like. Examples of the 1-phenyl-3-pyrazolidone developing agents are 1-phenyl-3-pyrazolidone, 4,4-dimethyl-1-phenyl-3-pyrazolidone, 4-hydroxymethyl-4-methyl-1-phenyl-3-pyrazolidone, 4,4-dihydroxymethyl-1-phenyl-3-pyrazolidone, and the like. Examples of the p-aminophenol developing agents are p-aminophenol, N-methyl-p-aminophenol, and the like.

Developers contain compounds capable of forming free sulfite ions as preservatives, e.g., sodium sulfite, potassium sulfate, potassium metabisulfite, sodium bisulfite, etc. Infectious developers may contain formaldehyde sodium bisulfite substantially incapable of providing free sulfite ions in the solution.

Alkali agents to be contained in developers include potassium hydroxide, sodium hydroxide, potassium carbonate, sodium carbonate, sodium acetate, potassium tertiary phosphate, diethanolamine, triethanolamine, etc. The developers are usually adjsuted to a pH of 9 or higher, and preferably 9.7 or higher.

The developers may contain organic compounds known as antifoggants or development restrainers. Examples of such organic compounds include azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds, e.g., oxazolinethione, etc.; azaindenes, e.g., triazaindenes, tetraazaindenes (sspecially 4-hydroxy substituted(1,3,3a,7)tetraazaindenes), pentaazaindenes, etc.; benzenethiosulfonic acid, benzenesulfinic acid, benzenesulfonic acid amide, sodium 2-mercaptobenzimidazole-5-sulfonate, and the like.

The developers which can be used in this invention can contain the similar polyalkylene oxides as described above as development restrainers. For example, polyethylene oxide having a molecular weight of from 1,000 to 10,000 can be used in an amount ranging from 0.1 to 10 g/liter.

The developers can preferably contain water softeners, such as nitrilotriacetic acid, ethylenediaminetetraacetic acid, triethylenetetraminehexaacetic acid, diethylenetetraminepentaacetic acid, etc.

Fixers having general compositions can be used in the present invention. Fixing agents to be used include thiosulfates and thiocyanates and, in addition, organic sulfur compounds known to exhibit a fixing effect.

The fixers may contain water-soluble aluminum salts as hardeners. They may further contain complexes of ethylenediaminetetraacetic acid and a trivalent iron ion as bleaching agents.

The light-sensitive materials according to the present invention are processed under appropriately determined conditions, usually at a processing temperature between 18° C. and 50° C. Rapid processing for a processing time of from 15 to 120 seconds by the use of an automatic developing machine is desirable.

The present invention will now be illustrated in greater detail with reference to the following examples, but it should be understood that these examples are not construed to limit the present invention. In these examples, all percents are by weight unless otherwise indicated.

EXAMPLE 1

A silver iodobromide emulsion having an iodine content of 1.5 mol% was prepared by precipitation according to a double jet process, followed by physical ripening, removal of salts and chemical ripening. The silver halide grains in the emulsion had a mean grain size of 0.3 μm. The emulsion contained 0.65 mol of silver halide per kg.

After 1 kg of the emulsion was dissolved by warming at 40° C., 30 mg of Sensitizing Dye III-6, 300 mg of Compound IV-3 and 420 mg of Compound V-3 were added thereto, followed by mixing with stirring. Then, 28 ml of a 1.0% aqueous solution of 1-hydroxy-3,5-dichlorotriazine sodium salt was added to the emulsion, and 40 ml each of 1.0% aqueous solutions of Surface Active Agents A-12 and B-8, respectively, was added thereto, followed by stirrer. The resulting emulsion was coated on a cellulose triacetate film support to a dry film thickness of 5 μm. A gelatin protective layer was provided on the emulsion layer. The resulting sample was designated as Sample 1.

Samples 2, 3, 6 and 8 were prepared in the same manner as described above but incorporating a dye of the formula (I) or dyes of the formulae (I) and (II) in the emulsion layer as shown in Table 1.

Samples 4, 5, 7 and 9 were prepared in the same manner as described for Sample 1 but incorporating 1 g/m$^2$ of Mordant A having the following formula in the protective layer and also incorporating a dye or dyes in the protective layer as shown in Table 1.

Mordant A:

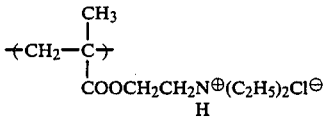

Each of the resulting film samples was exposed through an optical wedge to light emitted from a sensitometer equipped with a light source having a color temperature of 2,854° K., passing through a dark red filter (SC-74, produced by Fuji Photo Film Co., Ltd.). The exposed sample was subjected to development with a developer having the following formulation at 20° C. for 3 minutes, stopping, fixing and washing to obtain a strip having a prescribed black-and-white image.

| Developer Formulation: | |
|---|---|
| Water | 500 ml |
| N—Methyl-p-aminophenol | 2.2 g |
| Anhydrous Sodium Sulfite | 96.0 g |
| Hydroquinone | 8.8 g |
| Sodium Carbonate Monohydrate | 56.0 g |
| Potassium Bromide | 5.0 g |
| Water to make | 1 liter |

The densities of the image were determined using a P type densitometer (produced by Fuji Photo Film Co., Ltd.) to evaluate sensitivity and fog. The relative sensitivity was obtained from a reciprocal of an exposure which provided a density of 1.5, and was relatively expressed taking that of Sample 3 as 100 (standard).

Further, the sample was exposed to light emitted from a 10 W tungsten lamp at a distance of 2 m for 20 minutes through a safelight filter (No. 4, produced by Fuji Photo Film Co., Ltd.) on which a glass filter (IRA-05, produced by Tokyo Shibaura Electric Co., Ltd.) and a paraffin paper were laminated. The exposed film was developed, and the fog was determined in the same manner as described above.

These results obtained are shown in Table 1 below.

TABLE 1

| Sample No. | Dye | Amount of Dye (g/m$^2$) | Dye-Containing Layer | Exposure to Dark Red Light: Relative Sensitivity | Exposure to Dark Red Light: Fog | Fog after Exposure to Safelight |
|---|---|---|---|---|---|---|
| 1 | None | — | — | 100 (standard) | 0.06 | 0.18 |
| 2 | I-2 | 0.07 | Emulsion Layer | 79 | 0.09 | 0.13 |
| 3 | " | 0.14 | " | 71 | 0.10 | 0.11 |
| 4 | " | 0.07 | Protective Layer | 96 | 0.06 | 0.09 |
| 5 | " | 0.14 | " | 93 | 0.06 | 0.08 |
| 6 | I-2<br>II-21 | 0.07<br>0.07 | Emulsion Layer | 76 | 0.09 | 0.13 |
| 7 | I-2<br>II-21 | 0.07<br>0.07 | Protective Layer | 96 | 0.06 | 0.08 |
| 8 | I-9<br>II-2 | 0.05<br>0.05 | Emulsion Layer | 69 | 0.08 | 0.12 |
| 9 | I-9<br>II-2 | 0.05<br>0.05 | Protective Layer | 93 | 0.06 | 0.07 |

It can be seen from these results of Table 1 that Samples 4, 5, 7 and 9 in which the dye or dyes according to the present invention are incorporated in the protective layer undergo less fogging against exposure to safelight without suffering from great reduction in sensitivity. In other words, the present invention makes it possible to obtain highly sensitive light-sensitive materials which can be handled under bright safelight.

EXAMPLE 2

A silver chlorobromide emulsion having a bromine content of 30 mol% and a mean grain size of 0.35 μm was prepared in the same manner as described in Example 1. 4-Hydroxy-6-methyl-1,3,3a,7-tetraazaindene was added to the emulsion as a stabilizer.

To 1 kg of the emulsion were added 40 mg of the sensitizing dye of the formula (III) as shown in Table 2, 0.2 g of Compound IV-5 and 0.3 g of Compound V-2. Further, 1-hydroxy-3,5-dichlorotriazine sodium salt as a hardener and Surface Active Agents A-12 and B-8 as coating aids were added thereto in the same amounts as in Example 1. Each of the resulting emulsions was coated on a polyethylene terephthalate film support to a silver coverage of 3.9 g per m$^2$. A gelatin protective layer was provided on the emulsion layer to obtain Samples 10, 13, 16 and 19.

Samples 11, 14, 17 and 20 were prepared in the same manner as described above except that 0.15 g/m$^2$ of Dye I-6 or I-12 was incorporated in the emulsion layer as shown in Table 2.

Samples 12, 15, 18 and 21 were prepared in the same manner as described for Samples 10, 13, 16 and 19 except that 1 g/m$^2$ of Mordant B having the following formula and 0.15 g/m$^2$ of Dye I-6 or I-12 were incorporated in the protective layer as shown in Table 2.

Mordant B:

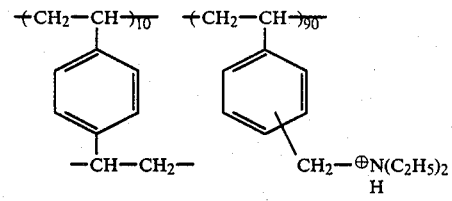

Each of the resulting samples was wedgewise exposed to light through a dark red filter (SC-72, produced by Fuji Photo Film Co., Ltd.), and the exposed film was subjected to development with a developer having the following formulation at 20° C. for 4 minutes, stopping, fixing and washing.

| Developer Formulation: | |
|---|---|
| Methol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metabisulfite | 1.5 g |
| Water to make | 1 liter |

The densities were determined by the use of a P type densitometer produced by Fuji Photo Film Co., Ltd. to obtain sensitivity and fog. The standard optical density for determining sensitivity was fog+1.0.

Further, fog after exposure to safelight was also determined in the same manner as described in Example 1.

The results obtained are shown in Table 2.

TABLE 2

| Sample No. | Sensitizing Dye | Dye | Dye-Containing Layer | Exposure through SC-72 Filter: Relative Sensitivity | Exposure through SC-72 Filter: Fog | Fog after Exposure to Safelight |
|---|---|---|---|---|---|---|
| 10 | III-2 | None | — | 100 (standard) | 0.05 | 0.10 |
| 11 | " | I-6 | Emulsion Layer | 83 | 0.07 | 0.09 |
| 12 | " | " | Protective Layer | 96 | 0.05 | 0.05 |
| 13 | III-25 | None | — | 100 (standard) | 0.05 | 0.09 |
| 14 | " | I-6 | Emulsion Layer | 85 | 0.07 | 0.09 |
| 15 | " | " | Protective Layer | 98 | 0.05 | 0.05 |
| 16 | III-29 | None | — | 100 (standard) | 0.05 | 0.11 |
| 17 | " | I-12 | Emulsion Layer | 66 | 0.08 | 0.09 |
| 18 | " | " | Protective Layer | 96 | 0.05 | 0.05 |
| 19 | III-34 | None | — | 100 (standard) | 0.04 | 0.11 |
| 20 | " | I-12 | Emulsion Layer | 60 | 0.07 | 0.08 |
| 21 | " | " | Protective Layer | 98 | 0.04 | 0.04 |

It can be seen from Table 2 that reduction in sensitivity can be lessened and fog after exposure to safelight can be inhibited in the samples according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive element comprising a support having provided thereon a silver halide light-sensitive emulsion layer that has been infrared-sensitized, so as to have a sensitivity maximum at a wavelength longer than 750 nm, with at least one sensitizing dye, present in a total amount of from $5\times10^{-7}$ to $5\times10^{-3}$ mol per mol of silver halide, selected from the group consisting of tricarbocyanine dyes represented by formula (IIIa) or (IIIb) and 4-quinoline nucleus-containing dicarbocyanine dyes represented by formula (IIIc)

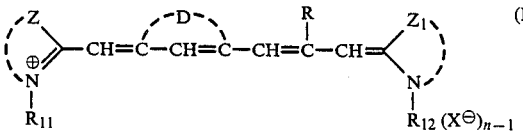

(IIIa)

wherein R represents a hydrogen atom, a methyl group, a methoxy group, or an ethoxy group; $R_{11}$ and $R_{12}$, which may be the same or different, each represents an alkyl group or a substituted alkyl group; D represents a divalent atomic group necessary to form a substituted or unsubstituted ethylenic linkage; Z and $Z_1$ each represents a non-metallic atomic group necessary to form a 5- or 6-membered nitrogen-containing heterocyclic ring; $X^{\ominus}$ represents an acid anion; and n represents 1 or 2;

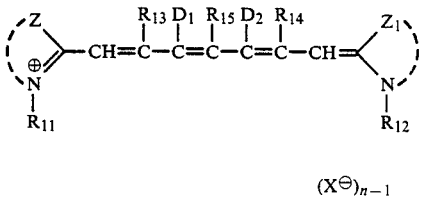

(IIIb)

wherein $R_{11}$, $R_{12}$, Z, $Z_1$, and $X^{\ominus}$ are the same as defined above for formula (IIIa); $R_{13}$ and $R_{14}$ each represents a hydrogen atom, a lower alkyl group, a lower alkoxy group, a phenyl group or a benzyl group; $R_{15}$ represents a hydrogen atom, a lower alkyl group, a lower alkoxy group, a phenyl group, a benzyl group or

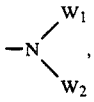

wherein $W_1$ and $W_2$ each represents a substituted or unsubstituted alkyl group having 1 to 18 carbon atoms in its alkyl moiety or an aryl group, or $W_1$ and $W_2$ together form a 5- or 6-membered nitrogen-containing heterocyclic ring; and $D_1$ and $D_2$ each represents a hydrogen atom, or $D_1$ and $D_2$ together form a substituted or unsubstituted ethylenic linkage;

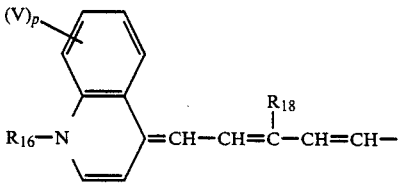

(IIIc)

-continued

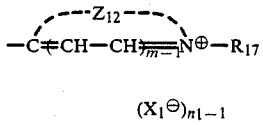

wherein $R_{16}$ and $R_{17}$ each represents an alkyl group or a substituted alkyl group; $R_{18}$ represents a hydrogen atom, a lower alkyl group, a lower alkoxy group, a phenyl group or a benzyl group; V represents a hydrogen atom, a lower alkyl group, an alkoxy group, a halogen atom, or a substituted alkyl group; $Z_{12}$ represents a non-metallic atomic group necessary to form a 5- or 6-membered nitrogen-containing heterocyclic ring; $X^{\ominus}$ represents an acid anion; and m, $n_1$ and p each represents 1 or 2, and at least one light-insensitive hydrophilic colloidal layer on said silver halide light-sensitive emulsion layer, wherein said light-insensitive hydrophilic colloidal layer contains a polymer mordant and at least one water-soluble dye, in a total amount of from $10^{-3}$ to 1 g/m$^2$, said dye having an absorption maximum at a wavelength between 350 nm and 750 nm, ratio of a density at 780 nm to a density at absorption maximum of 0.6 or less and being selected from dyes represented by formula (Ia)

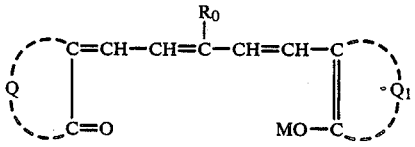

(Ia)

wherein Q and $Q_1$ each represents an atomic group necessary to form a pyrazolone, barbituric acid, thiobarbituric acid, isoxazolone, 3-oxythionaphthene, or 1,3-indanedione group; $R_0$ represents a hydrogen atom, a halogen atom, or a lower alkyl group; and M represents a hydrogen atom, a sodium atom, or a potassium atom; and dyes represented by formula (Id)

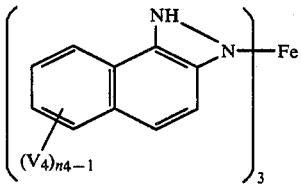

(Id)

wherein $V_4$ represents a sulfo group or a carboxyl group; and $n_4$ represents 2, 3 or 4.

2. A silver halide light-sensitive element as in claim 1, wherein said dye is a dye having an absorption maximum at a wavelength between 600 nm and 750 nm.

3. A silver halide light-sensitive element as in claim 1, wherein said dye is present in a total amount of from $10^{-3}$ to 0.5 g/m$^2$.

4. A silver halide light-sensitive element as in claim 1, wherein the sensitizing dye is used in a total amount of from $1\times10^{-6}$ to $1\times10^{-3}$ mol per mol of silver halide.

5. A silver halide light-sensitive element as in claim 1, wherein said silver halide emulsion layer contains a compound represented by formula (IV)

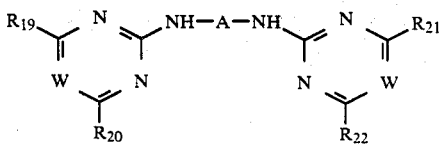

(IV)

wherein —A— represents a divalent aromatic residue containing or not containing an $-SO_3M$ group, wherein M represents a hydrogen atom or a water solubility-imparting cation; $R_{19}$, $R_{20}$, $R_{21}$ and $R_{22}$ each represents a hydrogen atom, a hydroxyl group, a lower alkyl group, an alkoxy group, an aryloxy group, a halogen atom, a heterocyclic ring, an alkylthio group, a heterocyclic thio group, an arylthio group, an amino group, an alkylamino group, a substituted alkylamino group, an arylamino group, a substituted arylamino group, a heterocyclic amino group, a substituted or unsubstituted aralkylamino group, an aryl group or a mercapto group; when —A— does not contain an $-SO_3M$ group, at least one of $R_{19}$, $R_{20}$, $R_{21}$ and $R_{22}$ contains at least one $-SO_3M$ group; and W represents —CH= or —N=.

6. A silver halide light-sensitive element as in claim 5, wherein said compound of formula (IV) is present in an amount of from about 0.01 to 5 g per mol of silver halide.

7. A silver halide light-sensitive element as in claim 1, wherein said silver halide emulsion layer contains a compound represented by formula (V)

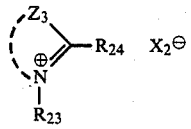

(V)

wherein $Z_3$ represents a non-metallic atomic group necessary to form a 5- or 6-membered nitrogen-containing heterocyclic ring; $R_{23}$ represents a hydrogen atom, an alkyl group having up to 8 carbon atoms or an alkenyl group; $R_{24}$ represents a hydrogen atom or a lower alkyl group; and $X_2^{\ominus}$ represents an acid anion.

8. A silver halide light-sensitive element as in claim 7, wherein said compound represented by formula (V) is present in an amount of from about 0.01 to 5 g per mol of silver halide.

9. A silver halide light-sensitive element as in claim 1, wherein said light-insensitive hydrophilic colloidal layer also contains a dye selected from dyes represented by formula (IIa)

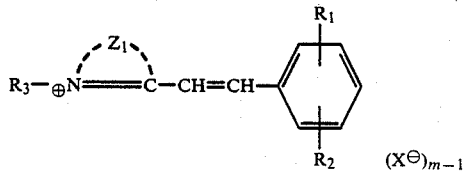

(IIa)

wherein $Z_1$ represents a non-metallic atomic group necessary to form a benzothiazole, naphthothiazole, or benzoxazole group; $R_1$ and $R_2$ each represents a hydrogen atom, an alkoxy group, a dialkylamino group, a sulfo group, or a halogen atom; $R_3$ represents a substituted or unsubstituted alkyl group; $X^{\ominus}$ represents an anion; and m represents 1 or 2; provided that when m is 1, X⊖ forms an inner salt in the molecule;

dyes represented by formula (IIb)

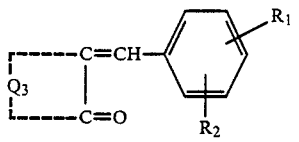

(IIb)

wherein $R_1$ and $R_2$ are the same as defined for formula (IIa) above; and $Q_3$ represents an atomic group necessary to form a pyrazolone, barbituric acid, thiobarbituric acid, isoxazolone, 3-oxythionaphthene, or 1,3-indanedione group;

dyes represented by formula (IIc)

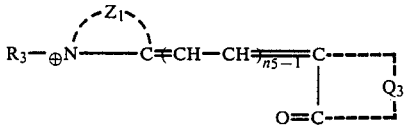

(IIc)

wherein $Z_1$, $Q^3$ and $R_3$ are the same as defined for formulae (IIa) and (IIb) above; and $n_5$ represents 1 or 2;

dyes represented by formula (IId)

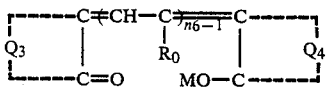

(IId)

wherein $Q_3$ is the same as defined for formula (IIb) above; $Q_4$ has the same meaning as $Q_3$; $R_0$ represents a substituted or unsubstituted alkyl group; M represents a hydrogen atom, a sodium atom or a potassium atom; and $n_6$ represents 1 or 2;

dyes represented by formula (IIe)

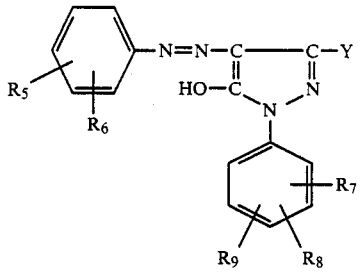

(IIe)

wherein Y represents an alkyl group or a carboxyl group; and $R_5$, $R_6$, $R_7$, $R_8$ and $R_9$ each represents a hydrogen atom, an alkyl group, a hydroxyl group, an amino group, an acylamino group, a carboxyl group or a sulfo group; or $R_5$ and $R_6$ together form a benzene ring;

and dyes represented by formula (IIf)

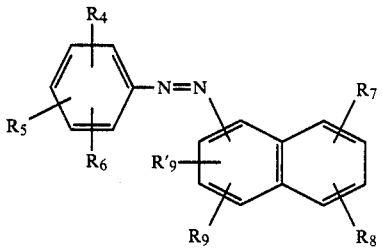

(IIf)

wherein $R_5$, $R_6$, $R_7$, $R_8$ and $R_9$ are the same as defined for formula (IIe); and $R_4$ and $R'_9$ each represents a group as defined for $R_5$, $R_6$, $R_7$, $R_8$ and $R_9$.

* * * * *